US009253866B2

(12) United States Patent
Someya et al.

(10) Patent No.: US 9,253,866 B2
(45) Date of Patent: Feb. 2, 2016

(54) GAS LOCK DEVICE AND EXTREME ULTRAVIOLET LIGHT GENERATION APPARATUS

(71) Applicant: GIGAPHOTON INC., Oyama-shi, Tochigi (JP)

(72) Inventors: Hiroshi Someya, Oyama (JP); Hideto Saito, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 14/172,535

(22) Filed: Feb. 4, 2014

(65) Prior Publication Data

US 2014/0216576 A1 Aug. 7, 2014

(30) Foreign Application Priority Data

Feb. 5, 2013 (JP) ..... 2013-020310

(51) Int. Cl.
*H05G 2/00* (2006.01)

(52) U.S. Cl.
CPC ..... *H05G 2/008* (2013.01); *H05G 2/006* (2013.01); *Y10T 137/8376* (2015.04)

(58) Field of Classification Search
USPC ..... 250/504 R; 137/560
See application file for complete search history.

(56) References Cited

U.S. PATENT DOCUMENTS 8,338,797 B2 * 12/2012 Derra ..... G03F 7/70916 250/423 R
2006/0192154 A1 8/2006 Algots et al.
2012/0223257 A1 * 9/2012 Nagai et al. ..... 250/504 R
2012/0241650 A1 * 9/2012 Yabu ..... H05G 2/003 250/504 R

* cited by examiner

*Primary Examiner* — Phillip A Johnston
*Assistant Examiner* — Hsien Tsai
(74) *Attorney, Agent, or Firm* — Studebaker & Brackett PC

(57) ABSTRACT

A gas lock device may include a chamber having a passage section and a connection hole that connects a surface to the passage section, an optical element that is attached to the chamber and seals the passage section, a gas supply apparatus, and a pipe that is attached at one end to the gas supply apparatus and attached at the other end to the chamber, and may define a flow channel communicating with the connection hole.

20 Claims, 16 Drawing Sheets

GAS LOCK DEVICE AND EXTREME ULTRAVIOLET LIGHT GENERATION APPARATUS

CROSS-REFERENCE TO A RELATED APPLICATION

The present application claims priority from Japanese Patent Application No. 2013-020310 filed Feb. 5, 2013.

BACKGROUND

1. Technical Field

The present disclosure relates to gas lock devices installed in chambers for generating extreme ultraviolet (EUV) light. The present disclosure further relates to apparatuses for generating extreme ultraviolet (EUV) light using such gas lock devices.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A gas lock device according to one aspect of the present disclosure may include a chamber, an optical element, a gas supply apparatus, and a pipe. The chamber may have a passage section and a connecting hole that connects a surface of the chamber to the passage section. The optical element may be attached to the chamber and seal the passage section. The pipe may be attached at one end to the gas supply apparatus and attached at the other end to the chamber, and may define a flow channel communicating with the connecting hole.

A gas lock device according to another aspect of the present disclosure may include a chamber, an optical element, a first cylinder member, a second cylinder member, a gas supply apparatus, and a pipe. The chamber may include a passage section. The optical element may be attached to the chamber and seal the passage section. The first cylinder member may be at least partially disposed within the passage section and may have a gap formed with the optical element. The second cylinder member may have an inner diameter that is greater than an outer diameter of the first cylinder member and may be at least partially disposed within the passage section and on an outer circumferential side of the first cylinder member. The pipe may be attached at one end to the gas supply apparatus and attached at the other end to the second cylinder member, and may define a flow channel communicating with a gap between the first cylinder member and the second cylinder member.

A gas lock device according to another aspect of the present disclosure may include a chamber, an optical element, a first cylinder member, a second cylinder member, a supply apparatus, and a pipe. The chamber may include a passage section. The optical element may be attached to the chamber and seal the passage section. The first cylinder member may be at least partially disposed within the passage section and may have an opening formed in an area within the passage section. The second cylinder member may have an inner diameter that is greater than an outer diameter of the first cylinder member and may be at least partially disposed within the passage section and on an outer circumferential side of the first cylinder member. The pipe may be attached at one end to the gas supply apparatus and attached at the other end to the second cylinder member, and may define a flow channel communicating with a gap between the first cylinder member and the second cylinder member.

BRIEF DESCRIPTION OF THE DRAWINGS

Hereinafter, selected embodiments of the present disclosure will be described with reference to the accompanying drawings.

DETAILED DESCRIPTION

Figure 1:
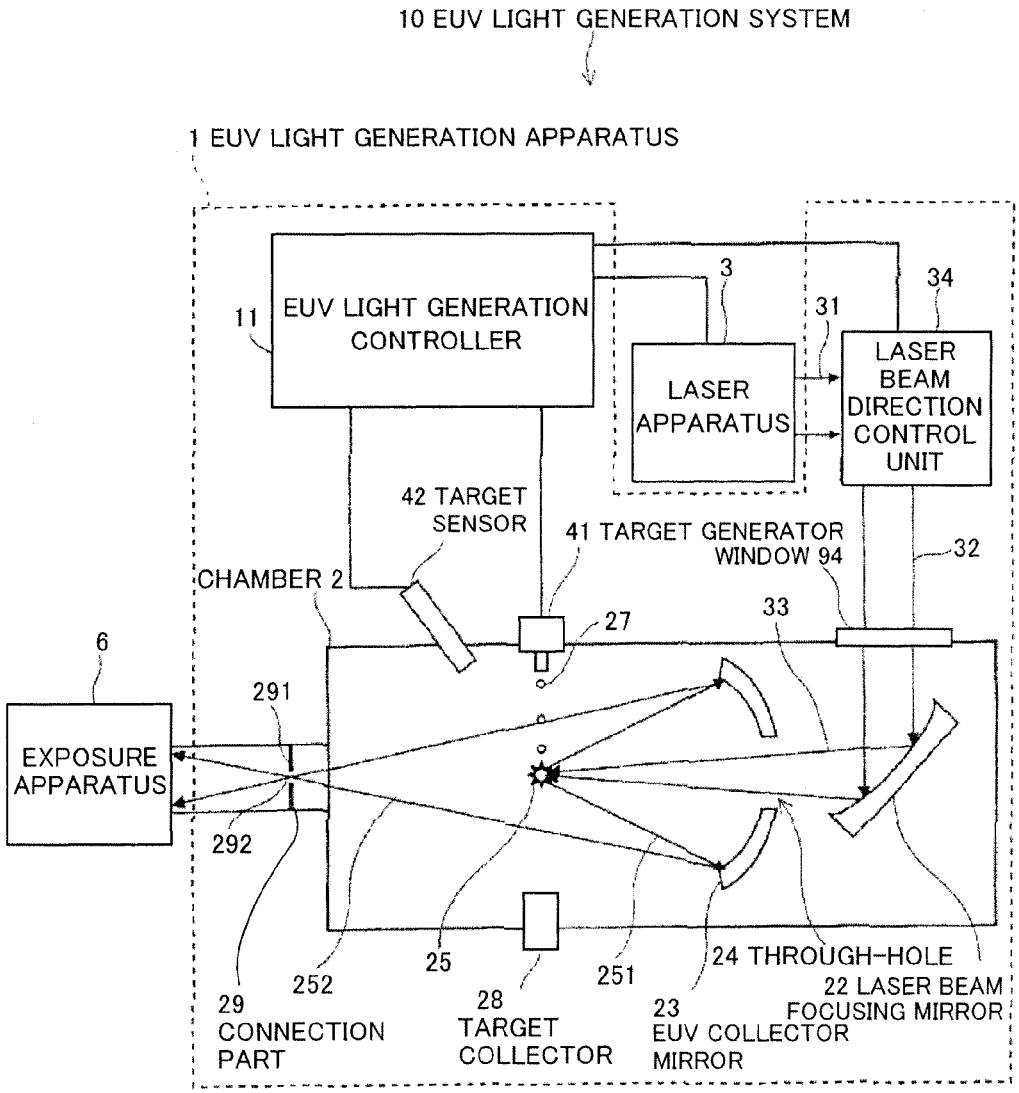
FIG. 1 illustrates the overall configuration of an exemplary LPP-type EUV light generation apparatus.

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

Contents

1. Overview
2. Terms
3. Overview of EUV Light Generation Apparatus
3.1 Configuration
3.2 Operation
4. EUV Light Generation Apparatus Including Gas Lock Device
4.1 Configuration
4.2 Operation
4.3 Issues
5. Structure of Gas Lock Device
5.1 First Embodiment
5.1.1 Configuration
5.1.2 Operation
5.1.3 Effect
5.2 Second Embodiment
5.2.1 Configuration
5.2.2 Operation
5.2.3 Effect
5.3 Third Embodiment
5.3.1 Configuration
5.3.2 Operation
5.3.3 Effect
5.4 Fourth Embodiment
5.4.1 Configuration
5.4.2 Operation
5.4.3 Effect
5.5 Fifth Embodiment
5.5.1 Configuration
5.5.2 Operation
5.5.3 Effect
5.6 Sixth Embodiment
5.6.1 Configuration
5.6.2 Operation
5.6.3 Effect
5.7 Seventh Embodiment
5.7.1 Configuration
5.7.2 Operation
5.7.3 Effect
5.8 Eighth Embodiment
5.8.1 Configuration
5.8.2 Operation
5.8.3 Effect
5.9 Ninth Embodiment
5.9.1 Configuration
5.9.2 Operation
5.9.3 Effect
6. Other 1. Overview In an LPP-type EUV light generation apparatus, a droplet of a target material (also called a "target") may be output into a chamber from a nozzle hole of a target supply device. The target supply device may be controlled so that the target reaches a plasma generation region within the chamber at a desired timing. The target may be turned into plasma by irradiating the target using a pulse laser beam when the target reaches the plasma generation region, and EUV light may be emitted from the plasma as a result.

When the target is irradiated by the pulse laser beam and is turned into plasma and the EUV light is generated as a result, the target, which is tin or the like, may diffuse due to impact caused by the expansion pressure of the plasma. The targets that have diffused due to the impact may diffuse as fine contaminant debris inside the chamber. It may be possible for the diffused debris to reach an optical element provided within the chamber. Debris that reaches the optical element may accumulate on the surface thereof, but may be removable by generating stannane gas under a reaction with a supplied hydrogen gas. However, there can be cases where it is difficult to effectively supply the hydrogen gas to the surface of the optical element, depending on the method used to supply the hydrogen gas. Accordingly, a mechanism for supplying the hydrogen gas can be large, a high amount of hydrogen gas can be used, and so on.

Accordingly, a gas lock device according to an embodiment of the present disclosure may include a chamber, at least one optical element, at least one gas supply apparatus, and a pipe. The chamber may have a passage section and a connecting hole that connects a surface of the chamber to the passage section. The optical element may be attached to the chamber and seal the passage section. The pipe may be attached at one end to the at least one gas supply apparatus and attached at the other end to the chamber, and may define a flow channel communicating with the connecting hole.

A gas lock device according to another aspect of the present disclosure may include a chamber, at least one optical element, a first cylinder member, a second cylinder member, at least one gas supply apparatus, and a pipe. The chamber may include a passage section. The optical element may be attached to the chamber and seal the passage section. The first cylinder member may be at least partially disposed within the passage section and may have a gap formed with the optical element. The second cylinder member may have an inner diameter that is greater than an outer diameter of the first cylinder member and may be at least partially disposed within the passage section and on an outer circumferential side of the first cylinder member. The pipe may be attached at one end to the at least one gas supply apparatus and attached at the other end to the second cylinder member, and may define a flow channel communicating with a gap between the first cylinder member and the second cylinder member.

According to this configuration, an embodiment of the present disclosure may provide a gas lock device having a small size and low running costs.

2. Terms

Several terms used in the present application will be described hereinafter. A "chamber" is a receptacle, in an LPP-type EUV light generation apparatus, that is used to isolate a space in which plasma is generated from the exterior. A "target supply device" is a device for supplying a target material that is used for generating EUV light, such as melted tin, to the interior of a chamber. An "EUV collector mirror" is a mirror for reflecting EUV light radiated from plasma and outputting that light to the exterior of a chamber. "Debris" can include a target material supplied to the interior of the chamber that has not been turned into plasma, ion particles and neutral particles emitted from the plasma, and so on, and is a matter that causes an optical element such as the EUV collector mirror to become soiled, damaged, or the like.

3. Overview of EUV Light Generation System 3.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 10. As shown in FIG. 1 and described in detail below, the EUV light generation system 10 may include a chamber 2 and a target supply device 26. The chamber 2 may be sealed airtight. The target supply device 26 may be mounted onto the chamber 2, for example, to penetrate a wall of the chamber 2. A target material to be supplied by the target supply device 26 may include, but is not limited to tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation system 10 may further include an EUV light generation controller 11 and a target sensor 42. The target sensor 42 may have an imaging function and detect at least one of the presence, trajectory, position, and speed of a target 27.

Further, the EUV light generation system 10 may include a connection part 29 for allowing the interior of the chamber 2 to be in communication with the interior of the exposure apparatus 6. A wall 291 having an aperture 293 may be provided in the connection part 29. The wall 291 may be positioned such that the second focus of the EUV collector mirror 23 lies in the aperture 293 formed in the wall 291.

The EUV light generation system 10 may also include a laser beam direction control unit 34, a laser beam focusing mirror22, and a target collector 28 for collecting targets 27. The laser beam direction control unit 34 may include an optical element (not separately shown) for adjusting the position and the orientation or posture of the optical element.

3.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 26 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 11 may be configured to integrally control the EUV light generation system 10. The EUV light generation controller 11 may be configured to process image data of the target 27 captured by the target sensor 42. Further, the EUV light generation controller 11 may be configured to control at least one of: the timing when the target 27 is outputted and the direction into which the target 27 is outputted. Furthermore, the EUV light generation controller 11 may be configured to control at least one of: the timing when the laser apparatus 3 oscillates, the direction in which the pulse laser beam 33 travels, and the position at which the pulse laser beam 33 is focused. It will be appreciated that the various controls mentioned above are merely examples, and other controls may be added as necessary.

4. EUV Light Generation Apparatus Including Gas Supply System 4.1 Configuration

Next, the EUV light generation apparatus 1 including a gas supply system 5 will be described.

Figure 2:
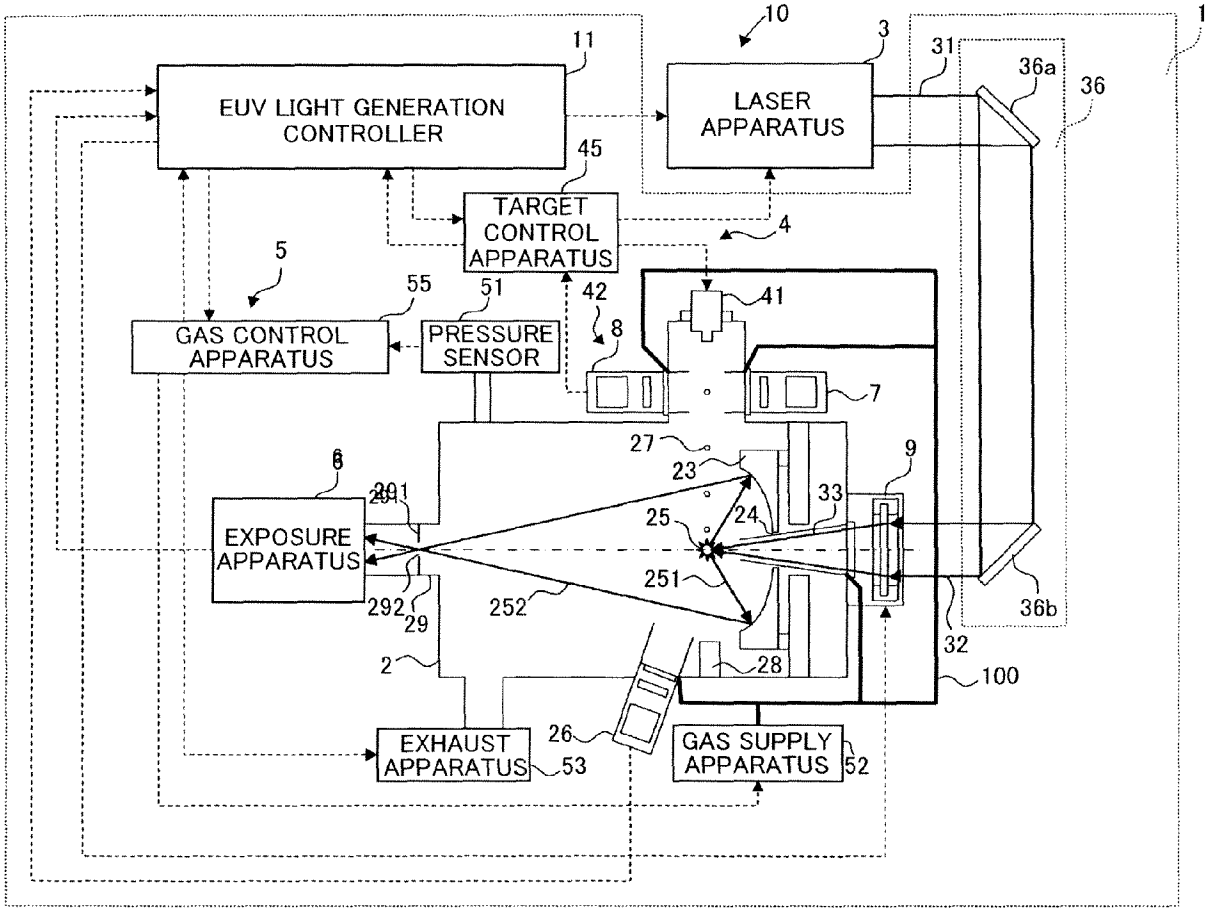
FIG. 2 is a diagram illustrating an EUV light generation apparatus according to an embodiment.

FIG. 2 is a diagram illustrating the EUV light generation apparatus 1 according to an embodiment.

As shown in FIG. 2, the EUV light generation apparatus 1 according to an embodiment of the present disclosure may include the chamber 2, the laser apparatus 3, a target control system 4, the gas supply system 5, a laser focusing section 9, a plasma sensor 26, and a beam delivery system 36. The beam delivery system 36 may include a first delivery mirror **36*a* and a second delivery mirror 36*b*. The plasma sensor 26 may be connected to the EUV light generation controller 11**.

The target control system 4 may include the target generator 41, the target sensor 42, and a target control apparatus 45.

The target generator 41 and the target sensor 42 may be disposed in the chamber 2. The target sensor 42 may include a light-emitting unit 7 and a light-receiving unit 8. The light-emitting unit 7 and the light-receiving unit 8 may be disposed facing each other on opposite sides of a trajectory along which the targets 27 drop from the target generator 41. The target generator 41 may be the same as in the embodiment illustrated in FIG. 1.

The gas supply system 5 may include a pressure sensor 51, a gas supply apparatus 52, an exhaust apparatus 53, a gas control apparatus 55, and a pipe 100.

The pressure sensor 51 and the exhaust apparatus 53 may be disposed in the chamber 2. The gas supply apparatus 52 may be an apparatus that supplies a gas containing hydrogen gas, and may be connected to the pipe 100. The pipe 100 may in turn be connected to the light-emitting unit 7, the light-receiving unit 8, the laser focusing section 9, and the plasma sensor 26.

4.2 Operation

Next, operations performed by the EUV light generation apparatus 1 including the gas supply system 5 will be described.

The EUV light generation controller 11 may send a control signal to the gas control apparatus 55. Based on a value detected by the pressure sensor 51, the gas control apparatus 55 may control at least one of an amount of gas supplied by the gas supply apparatus 52 and an amount of gas exhausted by the exhaust apparatus 53 so that a pressure within the chamber 2 reaches a predetermined value between, for example, several Pa to several hundred Pa. The gas containing hydrogen gas supplied from the gas supply apparatus 52 may be supplied to the light-emitting unit 7, the light-receiving unit 8, the laser focusing section 9, and the plasma sensor 26 through the pipe 100. The gas control apparatus 55 may send a signal to the EUV light generation controller 11 when the value detected by the pressure sensor 51 has reached the predetermined value.

After receiving the signal from the gas control apparatus 55 indicating that the value detected by the pressure sensor 51 has reached the predetermined value, the EUV light generation controller 11 may send, to the target control apparatus 45, a signal for outputting the target 27. The target control apparatus 45 may cause the target 27 to be output from the target generator 41 based on the signal sent from the EUV light generation controller 11.

The light-emitting unit 7 may output light through the trajectory of the targets 27, and the light-receiving unit 8 may detect shadows of or light reflected by the targets 27 caused by the output light. The light-receiving unit 8 may detect the targets 27 output from the target generator 41 based on the light output by the light-emitting unit 7. The light-receiving unit 8 may send a value of the detection to the target control apparatus 45. The target control apparatus 45 may calculate the trajectory of the targets 27 from the value of the detection made by the light-receiving unit 8. The target control apparatus 45 may send a control signal to the target generator 41 so that the trajectory of the targets 27 becomes a desired trajectory within a pre-set range. Based on the control signal sent from the target control apparatus 45, the target generator 41 may correct the trajectory of the targets 27 by, for example, carrying out feedback control on a dual-axis stage that supports the target generator 41.

In the case where the trajectory of the targets 27 has stabilized within the pre-set range, the target control apparatus 45 may output, to the laser apparatus 3, a trigger signal delayed by a predetermined amount of time, in synchronization with an output signal for the targets 27 output by the target generator 41. Alternatively, the target control apparatus 45 may send the output signal for the targets 27 output by the target generator 41 to the EUV light generation controller 11, and in such a case, the EUV light generation controller 11 may output the trigger signal to the laser apparatus 3. The delay time of the trigger signal may be set so that the pulse laser beam 33 strikes the target 27 when the target 27 arrives at the plasma generation region 25.

Referring to FIG. 2, the pulse laser beam 31 output from the laser apparatus 3 may be incident on the laser focusing section 9 as the pulse laser beam 32, whose direction of travel has been controlled via the beam delivery system 36. Angles of the first delivery mirror 36*a* and the second delivery mirror 36*b* of the beam delivery system 36 may be controlled by the laser beam direction control unit 34 shown in FIG. 1. Through this, the direction of travel of the pulse laser beam 31 may be controlled. The pulse laser beam 32 may then enter into the chamber 2 through the laser focusing section 9. The pulse laser beam 32 may advance into the chamber 2 along at least one laser beam path, and may strike at least one target 27 as the pulse laser beam 33.

The plasma sensor 26 may detect light radiated from plasma produced by the pulse laser beam 33 striking the target 27, and may send a result of the detection to the EUV light generation controller 11. Based on the result of the detection by the plasma sensor 26, the EUV light generation controller 11 may send a laser beam direction control signal to the laser beam direction control unit 34 via the laser apparatus. The laser beam direction control unit 34 may adjust the angles of the first delivery mirror 36*a* and the second delivery mirror 36*b* based on the laser beam direction control signal.

4.3 Issues

Figure 3:
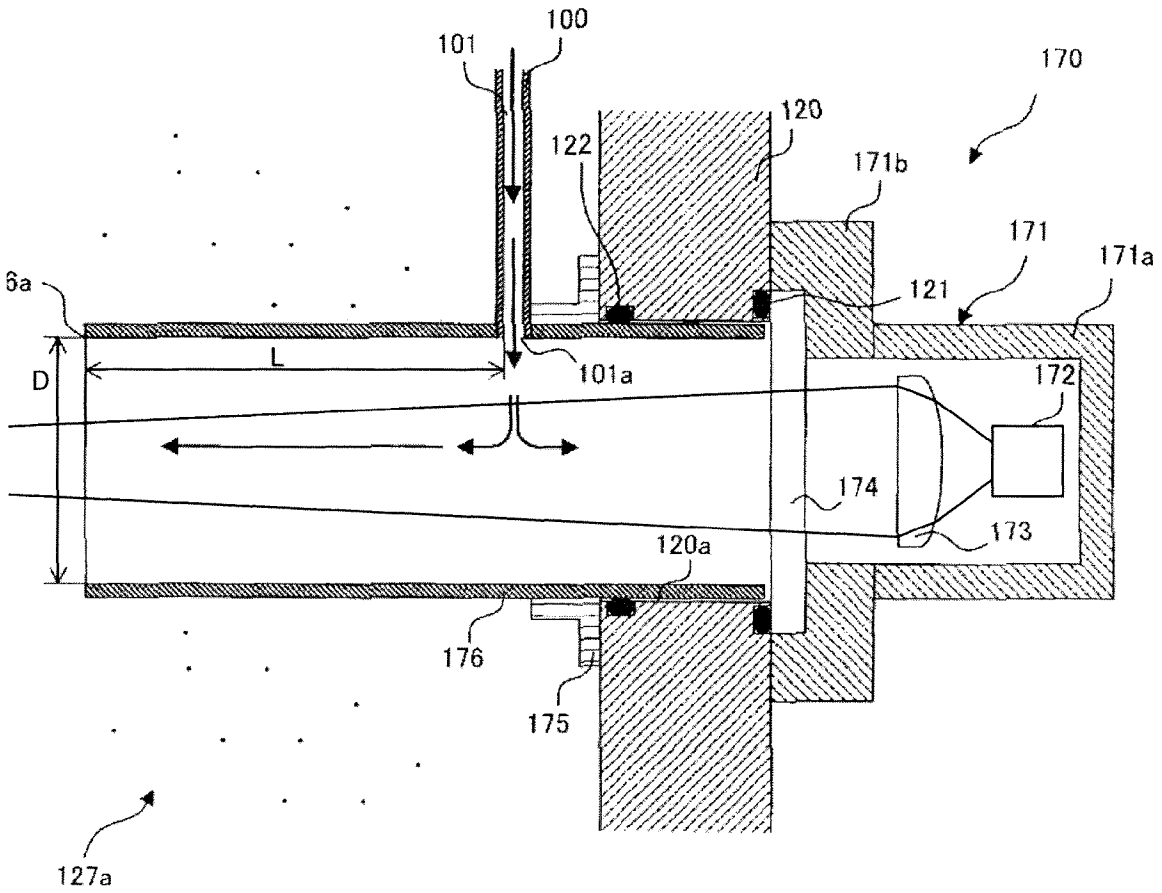
FIG. 3 is a diagram illustrating an issue with a gas lock device using an example for reference.

FIG. 3 is a diagram illustrating an issue with a gas lock device using an example for reference. The example for reference shown in FIG. 3 may use a light-emitting unit 170 and the vicinity thereof as an example. The light-emitting unit 170 may be an example used for comparison with the light-emitting unit 7 shown in FIG. 2.

The light-emitting unit 170 may include a holder 171, a light source 172, a focusing optical system 173, a window 174, a flange 175, and a cylinder member 176.

The holder 171 may include a light source holder 171*a* and a window holder 171*b*. The light source holder 171*a* may hold the light source 172 and the focusing optical system 173. The window holder 171*b* may be for attaching the window 174 to a chamber 120. The flange 175 may attach the cylinder member 176 to the chamber 120. The cylinder member 176 may be provided in an area on an inner side of the chamber 120 that is adjacent to the window 174. The pipe 100 may be connected to the cylinder member 176. A first O-ring 121 may be disposed between the window 174 and the chamber 120. A second O-ring 122 may be disposed between the chamber 120 and the cylinder member 176.

Light emitted from the light source 172 may be focused by the focusing optical system 173, traverse the window 174, pass through the trajectory of targets 127, and proceed toward a light-receiving unit (not shown). A flow channel 101 may be defined by the pipe 100. Gas containing hydrogen gas supplied from the flow channel 101 may be blown into the interior of the cylinder member 176 from a blowing portion 101*a*.

As a first issue, if the blowing portion 101*a* is distanced from the window 174 as in the example for reference shown in FIG. 3, the blown gas can separate into gas that flows toward a leading end 176*a* of the cylinder member 176 and gas that flows toward the window 174, as indicated by the arrows. Because there is no exhaust port, it can be possible for the gas that has flowed toward the window 174 to stagnate. Accordingly, in the case where debris 127*a* has advanced further than the blowing portion 101*a* toward the window 174, it can be difficult to push the debris 127*a* in a direction away from the window 174.

Accordingly, an embodiment of the present disclosure may provide a gas lock device that causes the debris 127*a* to flow with certainty. In other words, according to an embodiment of the present disclosure, the blowing portion 101*a* may be disposed in the vicinity of the window 174, and it may therefore be possible to cause the debris 127*a* to flow in a direction away from the window 174.

Next, a second issue will be described. As indicated by the example for reference shown in FIG. 3, the cylinder member 176 provided adjacent to the window 174 may serve as a barrier to the debris 127*a*. By serving as such a barrier, the cylinder member 176 may suppress the debris 127*a* from reaching the window 174. Furthermore, some of the gas containing hydrogen gas supplied from the blowing portion 101*a* may flow from inside the cylinder member 176 toward the opposite side to the side on which the window 174 is located. The debris 127*a* may be suppressed from entering into the cylinder member 176 and reaching the window 174 by the flow of the gas containing hydrogen gas.

Here, the diffusivity of the debris 127*a* may be represented as a Peclet number. The Peclet number may be expressed as indicated by the following Formula (1).

$$Pe=vL/Df \quad (1)$$

Here, Pe represents the Peclet number, v represents a flow velocity of the gas containing hydrogen gas (m/s), Df represents a diffusion coefficient of the debris 127*a* in the gas containing hydrogen gas, and L represents a distance from the blowing portion 101*a* of the supply flow channel 101 to the leading end 176*a* of the cylinder member 176.

In the case where the cylinder member 176 has a circular column shape as in the example for reference shown in FIG. 3, the Peclet number may be expressed as indicated by the following Formula (2).

$$Pe=\{(Q/P)(4/\pi D^2)L\}/Df \quad (2)$$

Here, Q represents a flow rate of the gas containing hydrogen gas that traverses the cylinder member 176, per unit of pressure ($Pa \cdot m^3/s$), P represents a pressure within the cylinder member 176 (Pa), and D represents an inner diameter of the cylinder member 176 (*m*).

If the amount of debris 127*a* that reaches the window 174 in the case where the gas containing hydrogen gas is used divided by the amount of debris 127*a* that reaches the window 174 in the case where the gas containing hydrogen gas is not used is taken as R, R may be expressed as indicated by the following Formula (3).

$$R=\mathrm{EXP}(Pe) \quad (3)$$

Judging from Formula (3), the Peclet number may be increased in order to suppress the debris 127*a* from reaching the window 174. Meanwhile, judging from Formula (2), the following three items may be considered in order to increase the Peclet number.

a. The flow rate Q of the gas containing hydrogen gas may be increased.

b. The distance L from the blowing portion 101*a* of the flow channel 101 for supplying the gas containing hydrogen gas to the leading end 176*a* of the cylinder member 176 may be increased.

c. The inner diameter D of the cylinder member 176 may be reduced.

However, the second issue may be that the following issues arise when increasing the Peclet number in each of these ways, as described below.

a'. If the flow rate Q of the gas containing hydrogen gas is increased, it may be possible that the running costs will increase.

b'. If the length of the cylinder member 176 is increased excessively, it may be possible that the cylinder member 176 will interfere with other members.

c'. If the inner diameter D of the cylinder member 176 is too small, it may be possible that the cylinder member 176 will interfere with an optical path of the light that passes through the optical element.

Accordingly, an embodiment of the present disclosure may provide a gas lock device having a small size and low running costs. In other words, the gas lock device according to an embodiment of the present disclosure may be capable of reducing the diffusion of the debris 127*a* while reducing the flow rate Q of the gas containing hydrogen gas, reducing the length of the cylinder member 176, and reducing the inner diameter D of the cylinder member 176 to the greatest extents possible.

5. Embodiments of Gas Lock Device 5.1 First Embodiment

Next, a first embodiment of the gas lock device will be described.

5.1.1 Configuration

Figure 4:
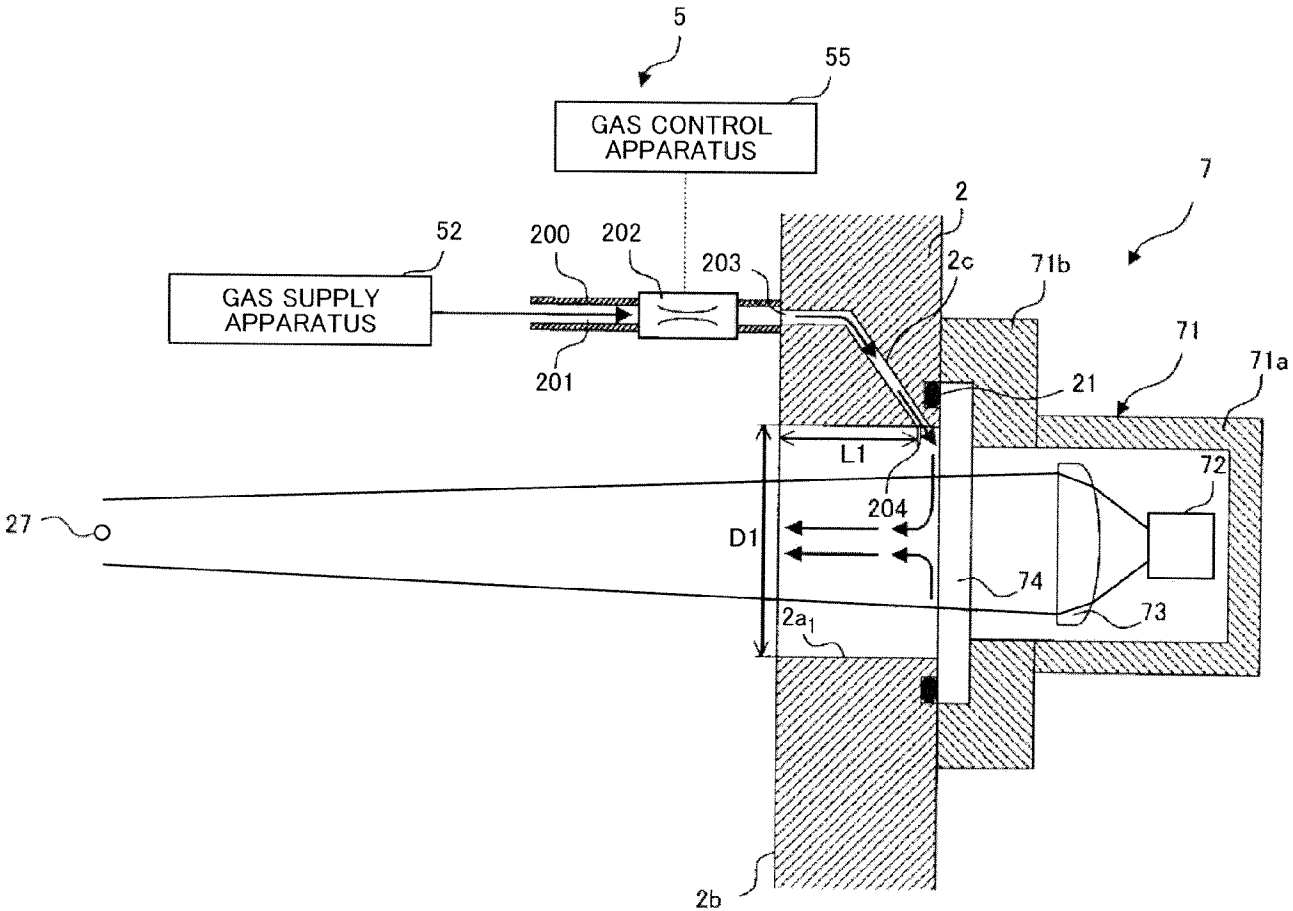
FIG. 4 is an enlarged view of the vicinity of a gas lock device according to a first embodiment.

FIG. 4 is an enlarged view of the vicinity of the gas lock device according to the first embodiment. The gas lock device according to the first embodiment may be used in the vicinity of the light-emitting unit 7, for example.

As shown in FIG. 4, the light-emitting unit 7 according to the first embodiment may include a holder 71, a light source 72, a focusing optical system 73, a window 74, a pipe 200, and an orifice portion 202. Note that the window 74 may configure an optical element.

An inner area of the pipe 200 may serve as a first flow channel 201. The chamber 2 may include a connection hole 2*c* that communicates with an opening formed in a passage section $2a_1$ from an opening formed in an inner-side surface 2*b*. The connection hole 2*c* may define a connecting flow channel 203. An area of the connection hole 2*c* that connects to the passage section $2a_1$ may define a blowing portion 204. A diameter of the passage section $2a_1$ may be represented by D1, and a distance from the blowing portion 204 to the inner-side surface 2*b* of the chamber 2 may be represented by L1.

The holder 71 may include a light source holder 71*a* and a window holder 71*b*. The light source holder 71*a* may hold the light source 72 and the focusing optical system 73. The passage section $2a_1$ may be provided in the chamber 2. The window 74 may be attached to the chamber 2 by the window holder 71*b* so as to seal the passage section $2a_1$. An O-ring 21 may be disposed between the window 74 and the chamber 2.

The pipe 200 may be connected at one end to at least one gas supply apparatus 52, and may be connected at another end to the connection hole 2*c* of the chamber 2. A flow channel that connects the first flow channel 201, the orifice portion 202, the connecting flow channel 203, and the blowing portion 204 may be defined by connecting the pipe 200 to the connection hole 2*c*.

5.1.2 Operation

Some light emitted from the light source 72 may be focused by the focusing optical system 73, traverse the window 74, pass through the trajectory of the targets 27, and proceed toward the light-receiving unit 8 shown in FIG. 2.

The orifice portion 202 may be controlled by the gas control apparatus 55 of the gas supply system 5 so as to control the diameter of the flow channel. A flow rate of the gas containing hydrogen gas that flows through the first flow channel 201 may be adjusted by the gas control apparatus 55 controlling the diameter of the orifice portion 202. The gas containing hydrogen gas whose flow rate has been adjusted by the orifice portion 202 may flow through the connecting flow channel 203, be blown toward the window 74 from the blowing portion 204, and flow into the passage section $2a_1$.

The gas containing hydrogen gas that has been blown from the blowing portion 204 may collide with the window 74 and flow along the surface of the window 74, as indicated by the arrows. The gas containing hydrogen gas that flows along the surface of the window 74 may then flow away from the window 74 within the pas sage section $2a_1$. The flow of the gas containing hydrogen gas may be a laminar flow.

5.1.3 Effect

According to the first embodiment, the blowing portion 204 may be disposed near the window 74, and it may therefore be possible to cause debris to flow in a direction away from the window 74 with certainty.

Furthermore, according to the first embodiment, the gas containing hydrogen gas may collide with the window 74 that serves as an optical element, flow along the window 74, and then flow away from the window 74. As a result, even if the debris reaches the window 74, the debris that has reached the window 74 can be removed from the window 74 by the flow of the gas containing hydrogen gas.

Further still, according to the first embodiment, the flow rate of the gas containing hydrogen gas passing through the first flow channel 201 may be adjusted using the orifice portion 202 depending on circumstances. For example, the flow rate of the gas containing hydrogen gas may be increased in the case where there is a high amount of debris. Alternatively, the flow rate of the gas containing hydrogen gas passing through the first flow channel 201 may be adjusted in accordance with periodic operations of the EUV light generation apparatus 1. The flow rate of the gas containing hydrogen gas can be controlled in this manner, making it possible to use an appropriate amount of gas, and the running costs may be reduced as a result.

In addition, according to the first embodiment, the gas containing hydrogen gas is blown into the passage section $2a_1$ of the chamber 2 from the blowing portion 204, and thus a cylinder member such as that shown in FIG. 3 need not be provided inside the inner-side surface 2*b* of the chamber 2. Ensuring the distance L1 from the blowing portion 204 to the inner-side surface 2*b* of the chamber 2 makes it possible to increase the Peclet number indicated in Formula (2) even if a cylinder member such as that shown in FIG. 3 is not used, and the debris may be suppressed from reaching the window 74 that serves as an optical element as a result.

Finally, according to the first embodiment, the gas containing hydrogen gas can flow along the passage section $2a_1$ as a laminar flow. Accordingly, it may be possible to reduce the occurrence of situations in which a turbulent flow causes the debris to continue to remain in the passage section $2a_1$.

5.2 Second Embodiment

Next, a second embodiment of the gas lock device will be described.

5.2.1 Configuration

Figure 5:
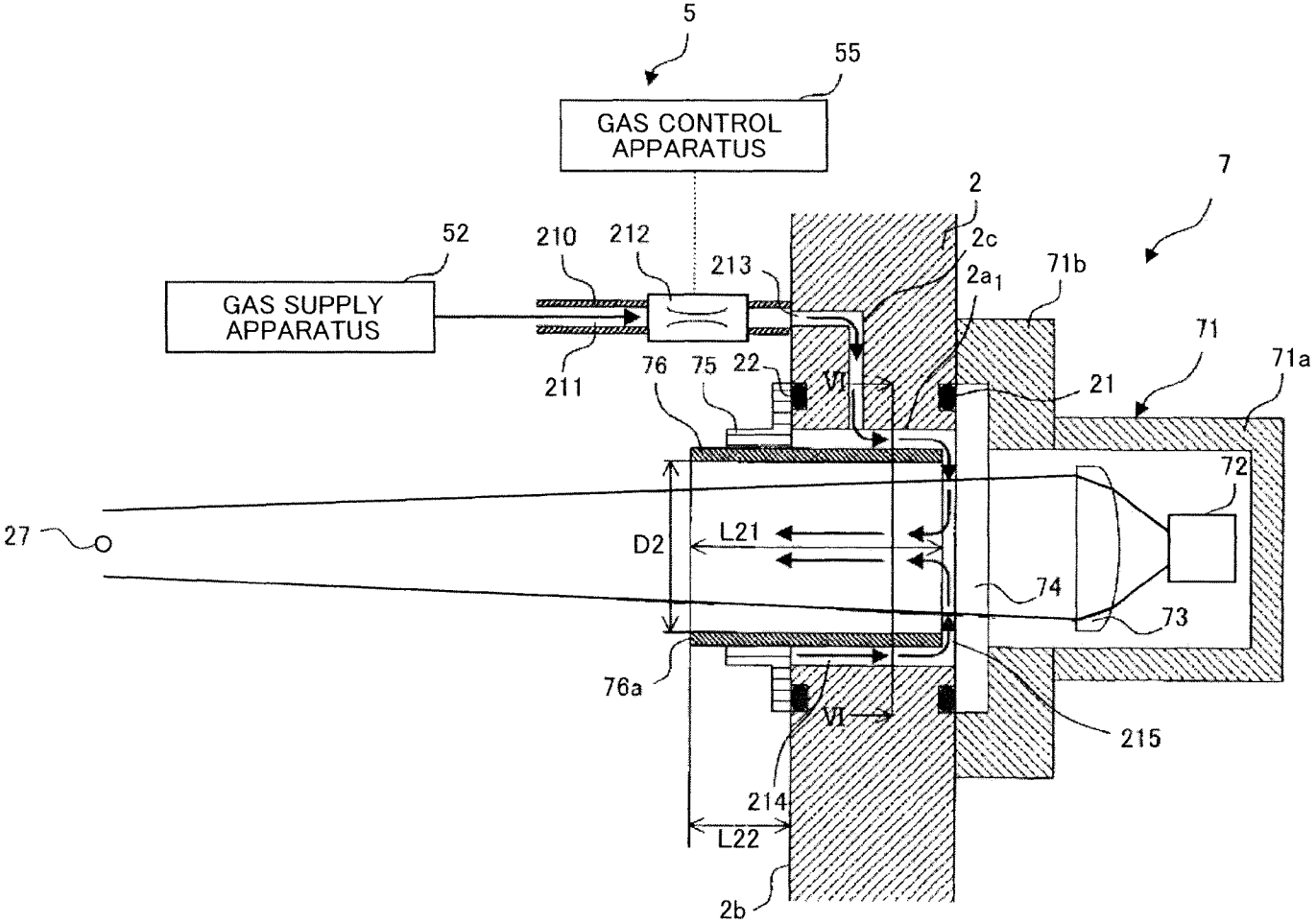
FIG. 5 is an enlarged view of the vicinity of a gas lock device according to a second embodiment.
Figure 6:
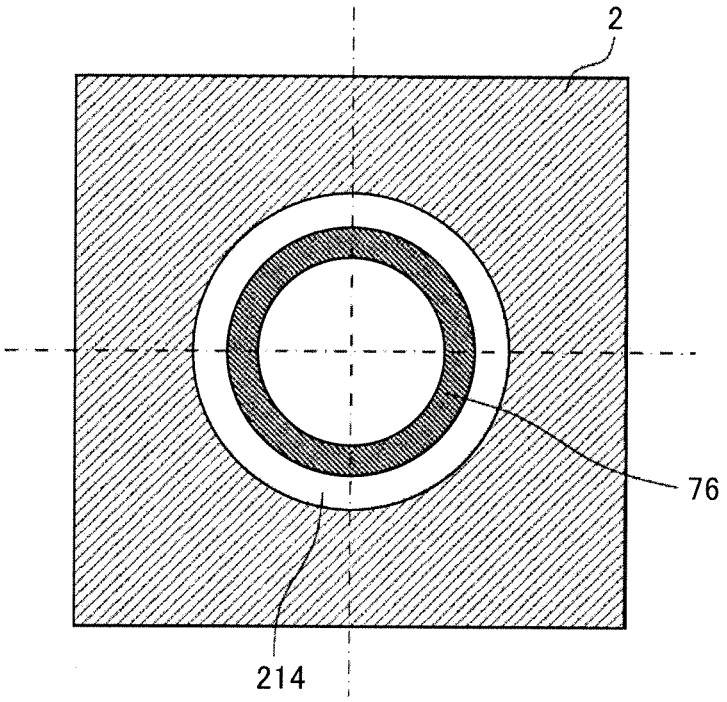
FIG. 6 is a diagram illustrating a cross-section taken along a VI-VI line in FIG. 5.

FIG. 5 is an enlarged view of the vicinity of the gas lock device according to the second embodiment. FIG. 6 is a cross-sectional view taken along the VI-VI line shown in FIG. 5. The gas lock device according to the second embodiment may be used in the vicinity of the light-emitting unit 7, for example.

As shown in FIG. 5, the light-emitting unit 7 according to the second embodiment may include the holder 71, the light source 72, the focusing optical system 73, the window 74, a flange 75, a cylinder member 76, a pipe 210, and an orifice portion 212. Of these, the holder 71, the light source 72, the focusing optical system 73, and the window 74 have the same configurations as those described in the first embodiment, and thus descriptions thereof will be omitted. Note that the window 74 may configure an optical element.

The outer diameter of the cylinder member 76 may be smaller than the diameter of the passage section $2a_1$ in the chamber 2. An inner area of the pipe 210 may serve as a first flow channel 211. The chamber 2 may include the connection hole 2*c* that connects to an opening formed in the passage section $2a_1$ from an opening formed in the inner-side surface 2*b*. The connection hole 2*c* may serve as a connecting flow channel 213.

At least part of the cylinder member 76 may be provided within the passage section $2a_1$. The cylinder member 76 may be attached to the chamber 2 via the flange 75. A second O-ring 22 may be disposed between the flange 75 and the chamber 2. One end portion of the cylinder member 76 may be disposed so that a gap is formed between that end portion of the cylinder member 76 and the window 74. The size of the gap may be substantially uniform along a circumferential direction of the cylinder member 76. Alternatively, a plurality of slits of equal sizes may be provided in the one end portion of the cylinder member 76, at equal intervals along the circumferential direction of the cylinder member 76. In this case, the areas aside from the slits may make contact with the window 74, but a slight gap may be formed instead. Alternatively, a plurality of holes of equal sizes may be provided in the vicinity of the end portion of the cylinder member 76, at equal intervals along the circumferential direction. In this case, the end portion of the cylinder member 76 may make contact with the window 74, but a slight gap may be formed instead.

The pipe 210 may be connected at one end to at least one gas supply apparatus 52, and may be connected at another end to the chamber 2 so as to connect to the connection hole 2*c* in the inner-side surface 2*b* of the chamber 2. A second flow channel 214 may be defined by a gap between the passage section $2a_1$ of the chamber 2 and the cylinder member 76. The gap formed between the cylinder member 76 and the window 74, the plurality of slits, or the plurality of holes may define a blowing portion 215.

A flow channel that connects the first flow channel 211, the orifice portion 212, the connecting flow channel 213, the second flow channel 214, and the blowing portion 215 may be defined by the pipe 210, the connection hole 2*c* of the chamber 2, the passage section $2a_1$ of the chamber 2 with the cylinder member 76, and the cylinder member 76 with the window 74.

An inner diameter of the cylinder member 76 may be represented by D2, a distance from the blowing portion 215 to a leading end 76*a* of the cylinder member 76 may be represented by L21, and a distance from the inner-side surface 2*b* of the chamber 2 to the leading end 76*a* of the cylinder member 76 may be represented by L22. The distance L21 from the blowing portion 215 to the leading end 76*a* of the cylinder member 76 may be the same as the length of the cylinder member 76.

5.2.2 Operation

The orifice portion 212 may be controlled by the gas control apparatus 55 of the gas supply system 5 so as to control the diameter of the flow channel. A flow rate of the gas containing hydrogen gas that flows through the first flow channel 211 may be adjusted by the gas control apparatus 55 controlling the diameter of the orifice portion 212. The gas containing hydrogen gas whose flow rate has been adjusted by the orifice portion 212 may flow through the connecting flow channel 213 and the second flow channel 214. The gas containing hydrogen gas that has flowed through the second flow channel 214 may collide with the window 74 slightly before the blowing portion 215, and may blow from the blowing portion 215 toward the inside of the cylinder member 76 that is at least partially disposed within the passage section $2a_1$ of the chamber 2.

The gas containing hydrogen gas that has been blown from the blowing portion 215 may flow along the surface of the window 74 from the periphery of the window 74 toward the center thereof, as indicated by the arrows. The gas containing hydrogen gas that has reached the vicinity of the center of the window 74 may flow in a direction away from the window 74. The gas containing hydrogen gas may flow along the cylinder member 76 as a laminar flow.

5.2.3 Effect

In addition to the effects of the first embodiment, according to the second embodiment, at least part of the cylinder member 76 may be disposed within the passage section $2a_1$ of the chamber 2, and thus the distance L22 from the blowing portion 215 to the leading end 76*a* of the cylinder member 76 may be ensured while reducing interference between the cylinder member 76 and other members. Accordingly, the Peclet number indicated in Formula (2) can be increased, and debris may be suppressed from reaching the window 74 that serves as an optical element as a result.

5.3 Third Embodiment

Next, a third embodiment of the gas lock device will be described.

5.3.1 Configuration

Figure 7:
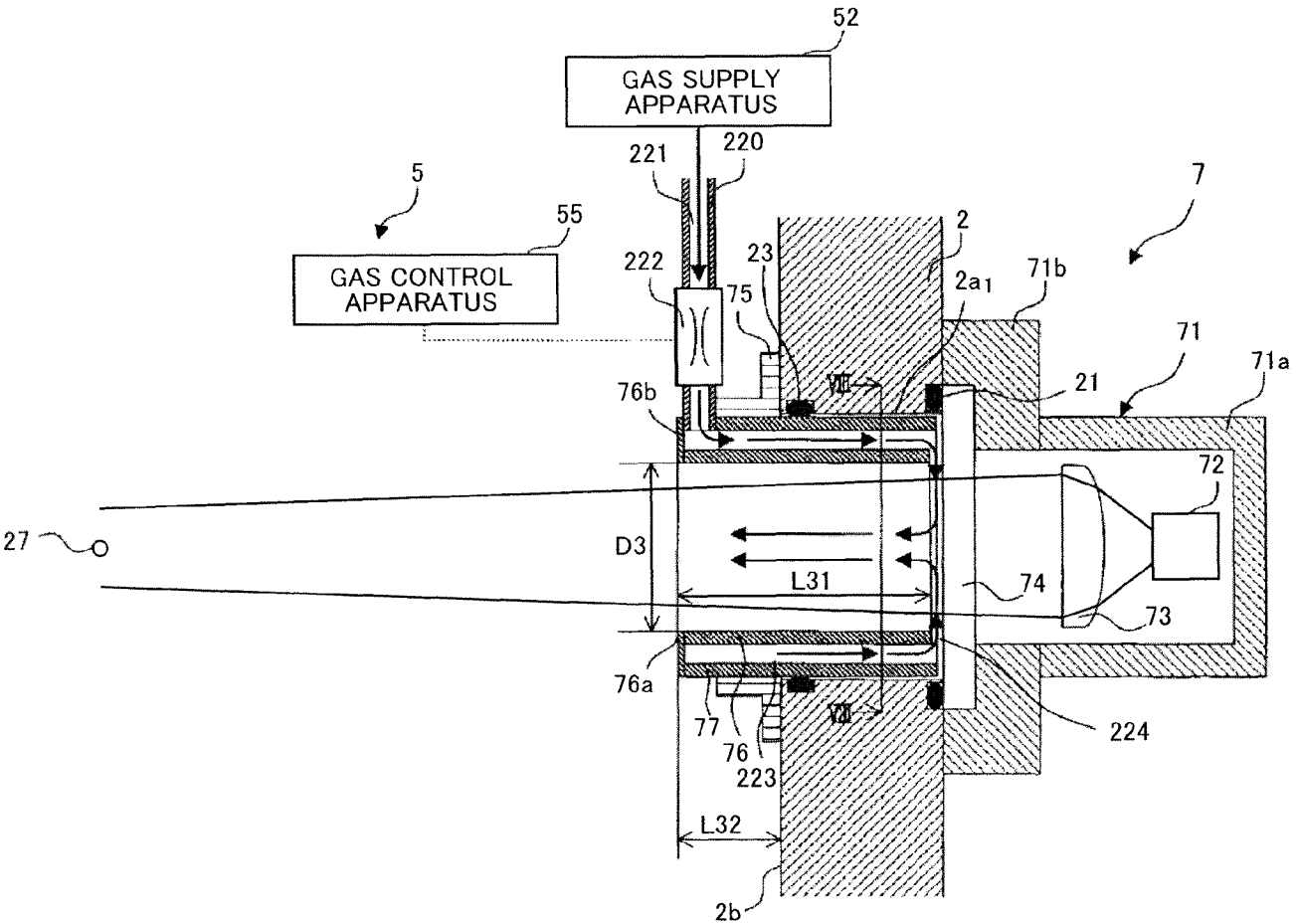
FIG. 7 is an enlarged view of the vicinity of a gas lock device according to a third embodiment.
Figure 8:
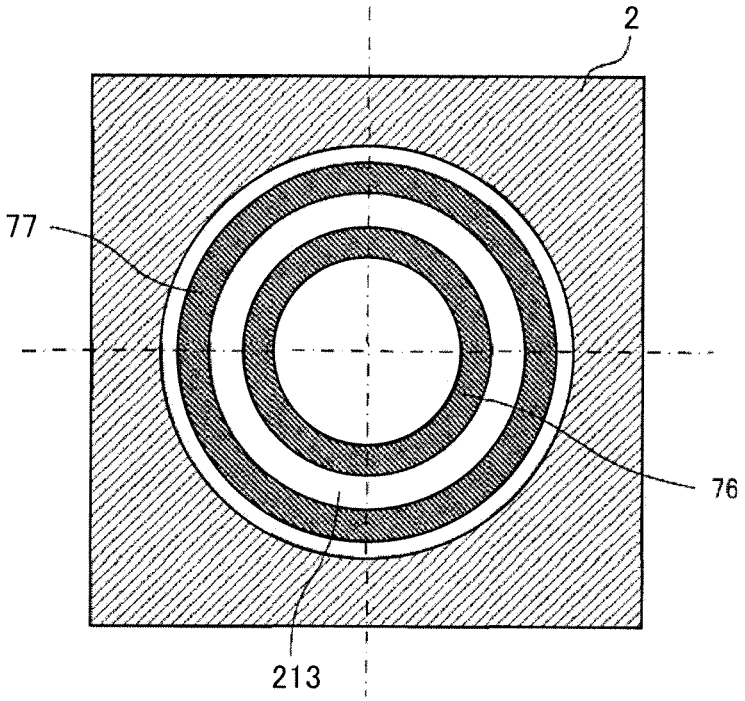
FIG. 8 is a diagram illustrating a cross-section taken along a VIII-VIII line in FIG. 7.

FIG. 7 is an enlarged view of the vicinity of the gas lock device according to the third embodiment. FIG. 8 is a cross-sectional view taken along the VIII-VIII line shown in FIG. 7. The gas lock device according to the third embodiment may be used in the vicinity of the light-emitting unit 7, for example.

As shown in FIG. 7, the light-emitting unit 7 according to the third embodiment may include the holder 71, the light source 72, the focusing optical system 73, the window 74, the flange 75, a first cylinder member 76, a second cylinder member 77, a pipe 220, and an orifice portion 222. Of these, the holder 71, the light source 72, the focusing optical system 73, and the window 74 have the same configurations as those described in the first embodiment, and thus descriptions thereof will be omitted. Note that the window 74 may configure an optical element.

An outer diameter of the first cylinder member 76 may be smaller than an inner diameter of the second cylinder member 77. The first cylinder member 76 may be inserted into the second cylinder member 77 so that a center axis of the first cylinder member 76 and a center axis of the second cylinder member 77 substantially match.

At least part of the first cylinder member 76 may be provided within the passage section $2a_1$. One end portion of the first cylinder member 76 may be disposed so that a gap is formed between that end portion of the first cylinder member 76 and the window 74. The size of the gap may be substantially uniform. Alternatively, the end portion may have the same configuration as the end portion of the cylinder member 76 according to the second embodiment. A cover portion 76*b* that seals a gap between the first cylinder member 76 and the second cylinder member 77 may be attached to the other end portion of the first cylinder member 76. Note that the cover portion 76*b* may be a separate entity from the first cylinder member 76. A leading end of the first cylinder member 76, including the cover portion 76*b*, may be indicated by 76*a*.

At least part of the second cylinder member 77 may be provided within the passage section $2a_1$. A third O-ring 23 may be disposed between the second cylinder member 77 and the chamber 2. An O-ring groove for the third O-ring 23 may be formed in the second cylinder member 77. The second cylinder member 77 may be attached to the chamber 2 via the flange 75.

The pipe 220 may include the orifice portion 222. The pipe 220 may be connected at one end to at least one gas supply apparatus 52, and may be connected at another end to the second cylinder member 77. A blowing portion 224 may be defined by a gap between the one end portion of the first cylinder member 76 and the window 74. The interior of the pipe 220 may serve as a first flow channel 221, and a space defined by the first cylinder member 76 and the second cylinder member 77 may serve as a second flow channel 223. The blowing portion 224 may be a gap, a plurality of slits, or a plurality of holes. The gap between the first cylinder member 76 and the window 74 may be 0.2 mm to 0.5 mm.

A flow channel that connects the first flow channel 221, the orifice portion 222, the second flow channel 223, and the blowing portion 224 may be defined by the pipe 220, the first cylinder member 76 with the second cylinder member 77, and the first cylinder member 76 with the window 74.

An inner diameter of the first cylinder member 76 may be represented by D3, a distance from the blowing portion 224 to the leading end 76*a* of the first cylinder member 76 may be represented by L31, and a distance from the inner-side surface 2*b* of the chamber 2 to the leading end 76*a* of the first cylinder member 76 may be represented by L32. The distance L31 from the blowing portion 224 to the leading end 76*a* of the first cylinder member 76 may be the same as the length of the first cylinder member 76. A relationship between the distance L32 and the distance L31 may be L32<L31.

5.3.2 Operation

The orifice portion 222 may be controlled by the gas control apparatus 55 of the gas supply system 5 so as to control the diameter of the flow channel. A flow rate of the gas containing hydrogen gas that flows through the first flow channel 221 may be adjusted by the gas control apparatus 55 controlling the diameter of the orifice portion 222. The gas containing hydrogen gas whose flow rate has been adjusted by the orifice portion 222 may flow through the second flow channel 223. The gas containing hydrogen gas flowing through the second flow channel 223 may collide with the window 74 and be blown from the blowing portion 224 toward the inside of the first cylinder member 76 that is at least partially disposed within the passage section $2a_1$ of the chamber 2.

The gas containing hydrogen gas that has been blown from the blowing portion 224 may flow along the surface of the window 74 from the periphery of the window 74 toward the center thereof, as indicated by the arrows. The gas containing hydrogen gas that has reached the vicinity of the center of the window 74 may flow in a direction away from the window 74. The gas containing hydrogen gas may flow along the first cylinder member 76 as a laminar flow.

5.3.3 Effect

In addition to the effects of the first embodiment, according to the third embodiment, the Peclet number indicated in Formula (2) can be increased by increasing the distance L31, and debris may be suppressed from reaching the window 74 that serves as an optical element as a result. In addition, it is not necessary to form the connection hole 2*c* in the chamber 2, and as a result it can be easy to add a gas lock to another window or the like that is not originally provided with a gas lock.

5.4 Fourth Embodiment

Next, a fourth embodiment of the gas lock device will be described. In the following, descriptions of constituent elements identical to those in the third embodiment will be omitted.

5.4.1 Configuration

Figure 9:
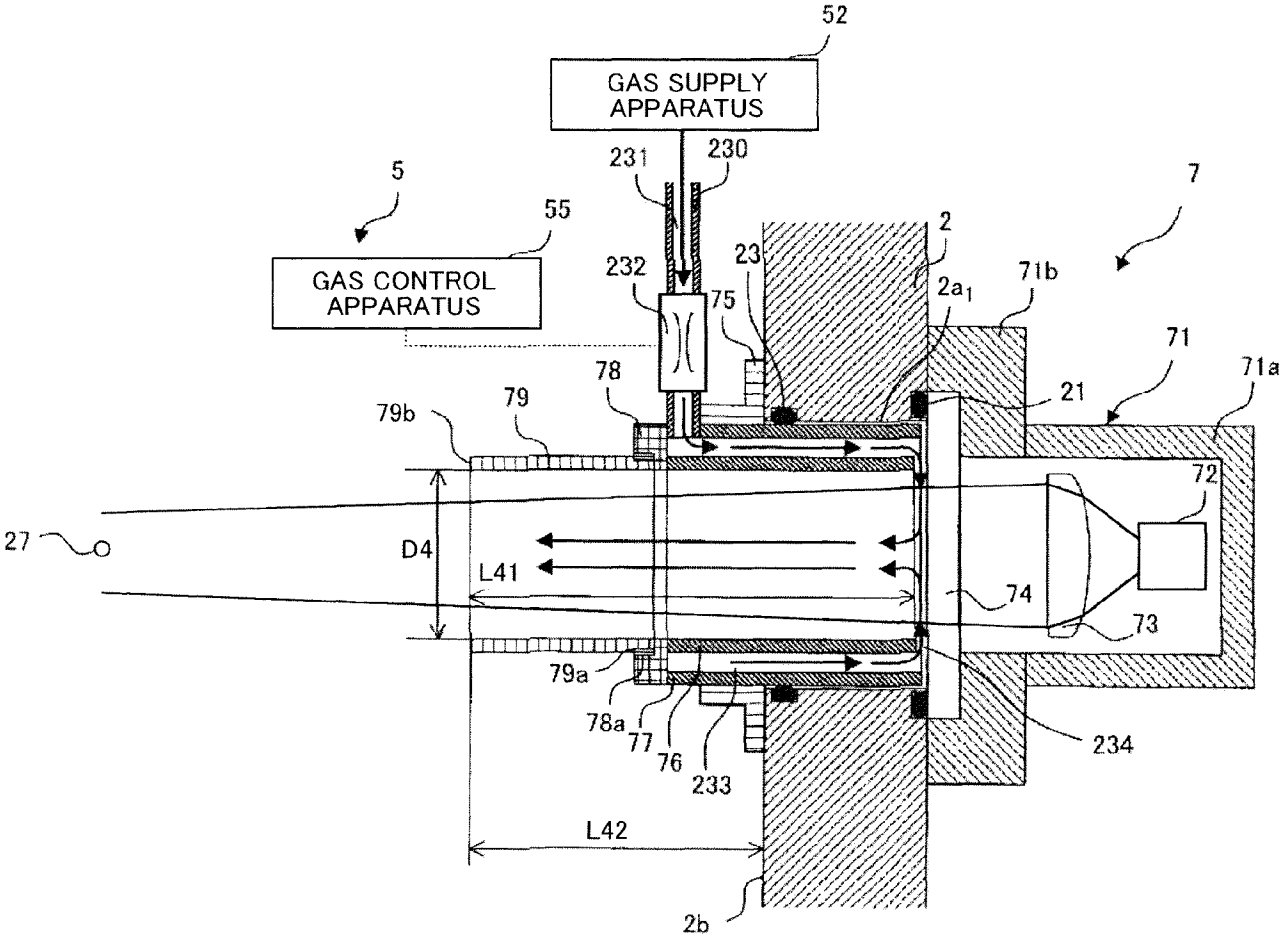
FIG. 9 is an enlarged view of the vicinity of a gas lock device according to a fourth embodiment.

FIG. 9 is an enlarged view of the vicinity of the gas lock device according to the fourth embodiment. The gas lock device according to the fourth embodiment may be used in the vicinity of the light-emitting unit 7, for example.

As shown in FIG. 9, the light-emitting unit 7 according to the fourth embodiment may include the holder 71, the light source 72, the focusing optical system 73, the window 74, the flange 75, the first cylinder member 76, the second cylinder member 77, a connecting member 78, a third cylinder member 79, a pipe 230, and an orifice portion 232. Of these, the holder 71, the light source 72, the focusing optical system 73, the window 74, the flange 75, the first cylinder member 76, and the second cylinder member 77 have the same configurations as those described in the third embodiment, and thus descriptions thereof will be omitted. Note that the window 74 may configure an optical element.

The connecting member 78 may be attached to the first cylinder member 76 and the second cylinder member 77 at end portions thereof located on the opposite side to the side on which the window 74 is located, so as to seal a gap therebetween. The connecting member 78 may include a screw portion 78*a*. The third cylinder member 79 may include a screw portion 79*a* with which the screw portion 78*a* of the connecting member 78 is threaded. The third cylinder member 79 may be screwed into the connecting member 78.

A plurality of types of the connecting member 78 and the third cylinder member 79 may be prepared, each having different lengths and diameters. The connecting member 78 and the third cylinder member 79 may then be selected from among the plurality of types and used in accordance with the circumstances.

An inner diameter of the third cylinder member 79 may be represented by D4, a distance from a blowing portion 234 to a leading end 79*b* of the third cylinder member 79 may be represented by L41, and a distance from the inner-side surface 2*b* of the chamber 2 to the leading end 79*b* of the third cylinder member 79 may be represented by L42.

5.4.2 Operation

Control of the orifice portion 232 performed by the gas control apparatus 55 may be the same as in the third embodiment. A flow rate of the gas containing hydrogen gas flowing through a first flow channel 231 may be adjusted by the orifice portion 232, and the gas containing hydrogen gas whose flow rate has been adjusted may flow through a second flow channel 233. The gas containing hydrogen gas flowing through the second flow channel 233 may collide with the window 74 and be blown from the blowing portion 234 toward the inside of the first cylinder member 76 that is at least partially disposed within the passage section $2a_1$ of the chamber 2.

The gas containing hydrogen gas that has been blown from the blowing portion 234 may flow along the surface of the window 74 from the periphery of the window 74 toward the center thereof, as indicated by the arrows. The gas containing hydrogen gas that has reached the vicinity of the center of the window 74 may flow in a direction away from the window 74 and toward the third cylinder member 79. The gas containing hydrogen gas may flow along the first cylinder member 76 and the third cylinder member 79 as a laminar flow.

5.4.3 Effect

In addition to the effects of the third embodiment, according to the fourth embodiment, the Peclet number indicated in Formula (2) can be further increased by further increasing the distance L41 from the blowing portion 234 to the leading end 79*b* of the third cylinder member 79, and debris may be further suppressed from reaching the window 74 that serves as an optical element as a result.

Furthermore, in addition to the effects of the third embodiment, according to the fourth embodiment, the connecting member 78 and the third cylinder member 79 may be selected from a plurality of types and used in accordance with circumstances such as a pressure, a temperature, or the like within the chamber 2, and as a result the distance L41 from the blowing portion 234 to the leading end 79*b* of the third cylinder member 79, the distance L42 from the inner-side surface 2*b* of the chamber 2 to the leading end 79*b* of the third cylinder member 79, and the inner diameter D4 of the third cylinder member 79 may be changed. Accordingly, the Peclet number indicated in Formula (2) can be changed in accordance with the circumstances, and debris may be suppressed from reaching the window 74 that serves as an optical element as a result.

5.5 Fifth Embodiment

Next, a fifth embodiment of the gas lock device will be described.

5.5.1 Configuration

Figure 10:
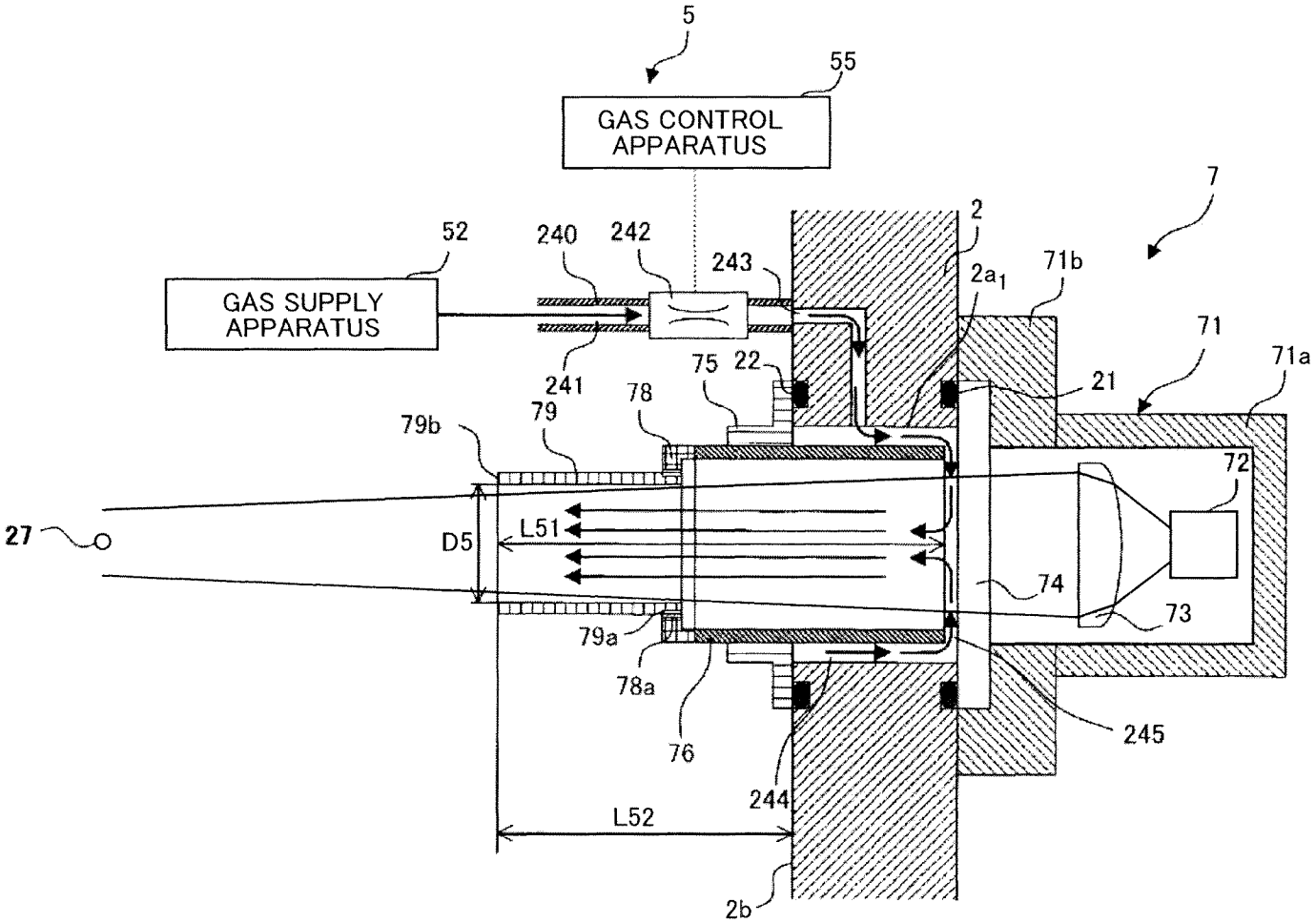
FIG. 10 is an enlarged view of the vicinity of a gas lock device according to a fifth embodiment.

FIG. 10 is an enlarged view of the vicinity of the gas lock device according to the fifth embodiment.

As shown in FIG. 10, the light-emitting unit 7 according to the fifth embodiment may be configured by attaching the connecting member 78 and the third cylinder member 79 to the cylinder member 76 of the light-emitting unit 7 according to the second embodiment illustrated in FIG. 5. The other configurations may be the same as those described in the second embodiment. Descriptions of constituent elements identical to those in the second embodiment will be omitted.

An inner diameter of the third cylinder member 79 may be represented by D5, a distance from a blowing portion 245 to the leading end 79*b* of the third cylinder member 79 may be represented by L51, and a distance from the inner-side surface 2*b* of the chamber 2 to the leading end 79*b* of the third cylinder member 79 may be represented by L52.

5.5.2 Operation

Control of an orifice portion 242 performed by the gas control apparatus 55 may be the same as in the second embodiment. A flow rate of the gas containing hydrogen gas flowing through a first flow channel 241 may be adjusted by controlling the diameter of the orifice portion 242, and the gas containing hydrogen gas whose flow rate has been adjusted may flow through a connecting flow channel 243 and a second flow channel 244. The gas containing hydrogen gas flowing through the second flow channel 244 may collide with the window 74 and be blown from the blowing portion 245 toward the inside of the first cylinder member 76 that is at least partially disposed within the passage section $2a_1$ of the chamber 2.

The gas containing hydrogen gas that has been blown from the blowing portion 245 may flow along the surface of the window 74 from the periphery of the window 74 toward the center thereof, as indicated by the arrows. The gas containing hydrogen gas that has reached the vicinity of the center of the window 74 may flow in a direction away from the window 74 and toward the third cylinder member 79. The gas containing hydrogen gas may flow along the first cylinder member 76 and the third cylinder member 79 as a laminar flow.

5.5.3 Effect

The fifth embodiment may provide the same effects as those of the second embodiment and the fourth embodiment.

5.6 Sixth Embodiment

Next, a sixth embodiment of the gas lock device will be described.

5.6.1 Configuration

Figure 11:
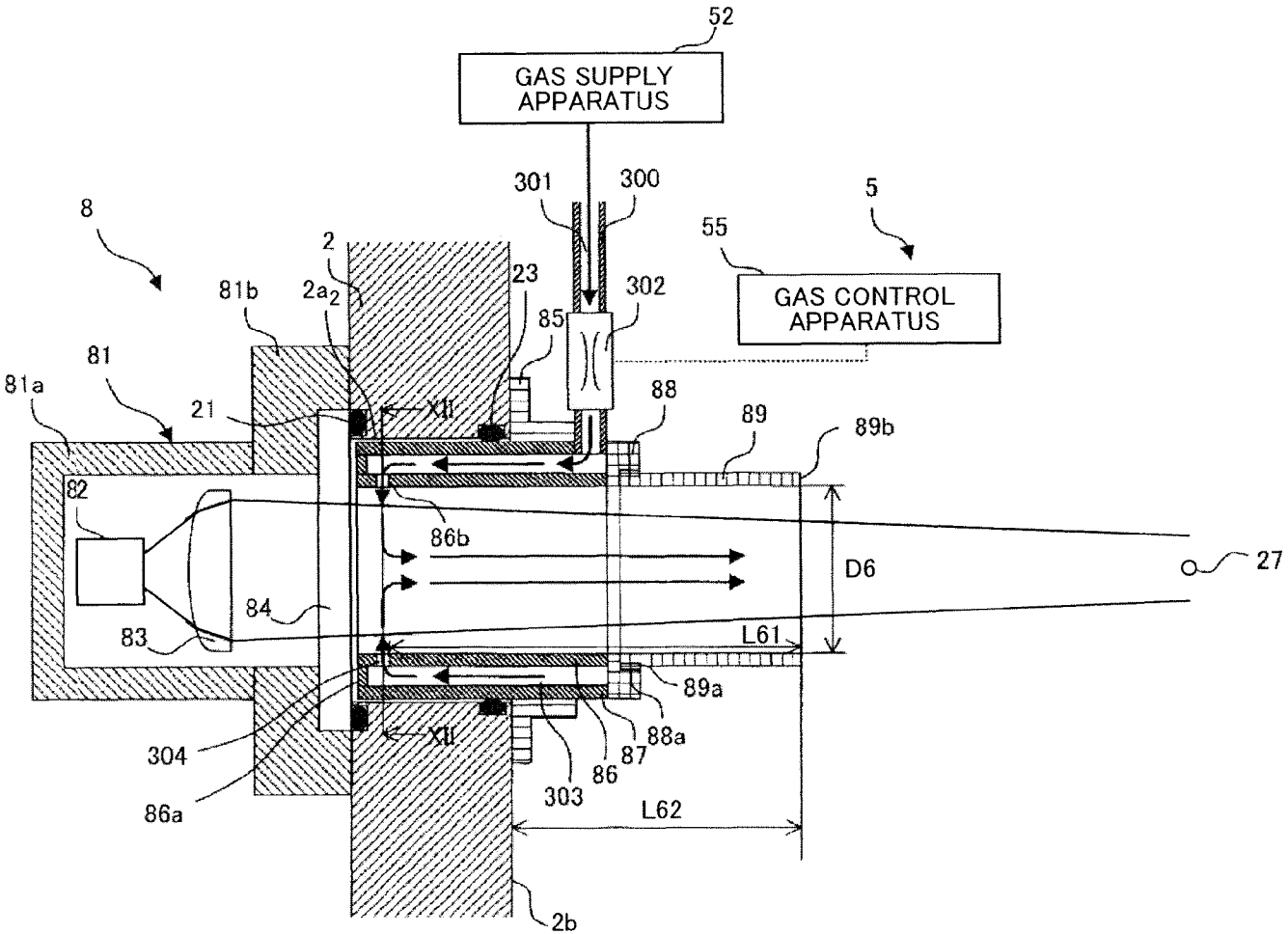
FIG. 11 is an enlarged view of the vicinity of a gas lock device according to a sixth embodiment.
Figure 12:
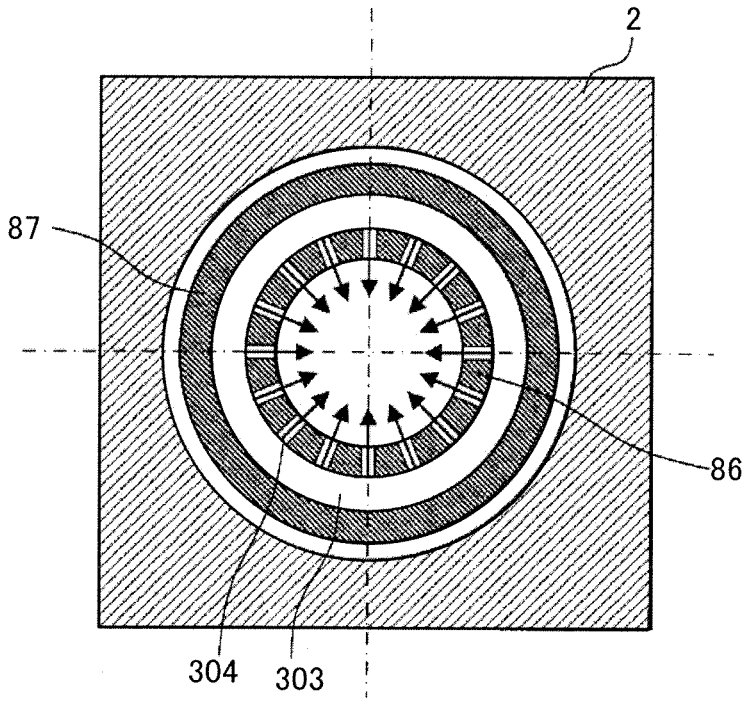
FIG. 12 is a diagram illustrating a cross-section taken along an XII-XII line in FIG. 11.

FIG. 11 is an enlarged view of the vicinity of the gas lock device according to the sixth embodiment. FIG. 12 is a cross-sectional view taken along the XII-XII line shown in FIG. 11. The gas lock device according to the sixth embodiment may be used in the vicinity of the light-receiving unit 8, for example.

As shown in FIG. 11, the light-receiving unit 8 according to the sixth embodiment may include a holder 81, an image sensor 82, a transfer optical system 83, a window 84 that serves as an optical element, a flange 85, a first cylinder member 86, a second cylinder member 87, a connecting member 88, a third cylinder member 89, a pipe 300, and an orifice portion 302.

An outer diameter of the first cylinder member 86 may be smaller than an inner diameter of the second cylinder member 87. The first cylinder member 86 may be inserted into the second cylinder member 87 so that a center axis of the first cylinder member 86 and a center axis of the second cylinder member 87 substantially match.

The holder 81 may include an image sensor holder 81*a* and a window holder 81*b*. The image sensor holder 81*a* may hold the image sensor 82 and the transfer optical system 83. The window holder 81*b* may be for attaching the window 84 to the chamber 2. A first O-ring 21 may be disposed between the window 84 and the chamber 2.

At least part of the first cylinder member 86 may be provided within a passage section $2a_2$ of the chamber 2. A cover portion 86*a* may be provided at an end portion of the first cylinder member 86 that is closer to the window 84 so as to seal a gap between the first cylinder member 86 and the second cylinder member 87. Note that the cover portion 86*a* may be provided in the second cylinder member 87. Furthermore, the cover portion 86*a* may be provided as a member that is separate from the first cylinder member 86 and the second cylinder member 87.

At least part of the second cylinder member 87 may be provided within the passage section $2a_2$ of the chamber 2. The third O-ring 23 may be disposed between the second cylinder member 87 and the chamber 2. The second cylinder member 87 may be attached to the chamber 2 via the flange 85.

The connecting member 88 may be attached to the first cylinder member 86 and the second cylinder member 87 at end portions thereof located on the opposite side to the side on which the window 84 is located, so as to seal a gap therebetween. The connecting member 88 may include a screw portion 88*a*. The third cylinder member 89 may include a screw portion 89*a* with which the screw portion 88*a* of the connecting member 88 is threaded. The connecting member 88 and the third cylinder member 89 need not be attached. In this case, a member that seals the gap between the first cylinder member 86 and the second cylinder member 87 may be attached instead of the connecting member 88.

A plurality of types of the connecting member 88 and the third cylinder member 89 may be prepared, each having different lengths and diameters. The connecting member 88 and the third cylinder member 89 may then be selected from among the plurality of types and used in accordance with the circumstances.

The pipe 300 may include the orifice portion 302. The pipe 300 may be connected at one end to at least one gas supply apparatus 52, and may be attached at another end to the second cylinder member 87. The interior of the pipe 300 may serve as a first flow channel 301, and a space defined by the first cylinder member 86 and the second cylinder member 87 may serve as a second flow channel 303. A blowing portion 304 may be defined by a hole 86*b* that serves as an opening in the first cylinder member 86. The blowing portion 304 may be a plurality of holes or a ring-shaped slit serving as the opening. A flow channel may be formed by the first flow channel 301, the orifice portion 302, the second flow channel 303, and the blowing portion 304.

5.6.2 Operation

Some of the light output by the light-emitting unit 7 as illustrated in FIG. 2 may pass through the trajectory of the targets 27, traverse the window 84, be focused by the transfer optical system 83, and proceed toward the light-receiving unit 8.

The diameter of the orifice portion 302 may be controlled by the gas control apparatus 55 of the gas supply system 5. A flow rate of the gas containing hydrogen gas that flows through the first flow channel 301 may be adjusted by controlling the diameter of the orifice portion 302. The gas containing hydrogen gas whose flow rate has been adjusted by the orifice portion 302 may flow through the second flow channel 303. The gas containing hydrogen gas flowing through the second flow channel 303 may be blown from the blowing portion 304 into the first cylinder member 86 that is at least partially disposed within the passage section $2a_2$ of the chamber 2.

The gas containing hydrogen gas that has been blown from the blowing portion 304 may flow along the surface of the window 84 from the periphery of the window 84 toward the center thereof, as indicated by the arrows. The gas containing hydrogen gas that has reached the vicinity of the center of the window 84 may flow in a direction away from the window 84 and toward the third cylinder member 89. The gas containing hydrogen gas may flow along the first cylinder member 86 as a laminar flow.

5.6.3 Effect

According to the sixth embodiment, the blowing portion 304 may be disposed near the window 84, and it may therefore be possible to cause debris to flow in a direction away from the window 84 with certainty.

Furthermore, according to the sixth embodiment, the gas containing hydrogen gas may be blown at a location near the window 84 that serves as an optical element. As a result, even if the debris reaches the window 84, the debris that has reached the window 84 can be removed from the window 84 by the flow of the gas containing hydrogen gas.

Further still, according to the sixth embodiment, the flow rate of the gas containing hydrogen gas that is supplied from the first flow channel 301 can be adjusted to an appropriate rate using the orifice portion 302 according to the circumstances, and the running costs may be reduced as a result.

In addition, according to the sixth embodiment, a relationship between a distance L62 from the inner-side surface 2*b* of the chamber 2 to a leading end 89*b* of the third cylinder member 89 and a distance L61 from the blowing portion 304 for the gas containing hydrogen gas to the leading end 89*b* of the third cylinder member 89 may be $L62<L61$. As a result, the Peclet number indicated in Formula (2) can be increased, and debris may be suppressed from reaching the window 84 that serves as an optical element as a result.

In addition, according to the sixth embodiment, the connecting member 88 and the third cylinder member 89 may be selected from a plurality of types and used in accordance with circumstances such as a pressure, a temperature, or the like within the chamber 2, and as a result the distance L61, the distance L62, and an inner diameter D6 of the third cylinder member 89 may be changed. Accordingly, the Peclet number indicated in Formula (2) can be changed in accordance with the circumstances, and debris may be suppressed from reaching the window 84 that serves as an optical element as a result.

Finally, according to the sixth embodiment, the gas containing hydrogen gas can flow along the first cylinder member 86 as a laminar flow. Accordingly, it may be possible to reduce the occurrence of situations in which a turbulent flow causes the debris to continue to remain in the first cylinder member 86.

5.7 Seventh Embodiment

Next, a seventh embodiment of the gas lock device will be described.

5.7.1 Configuration

Figure 13:
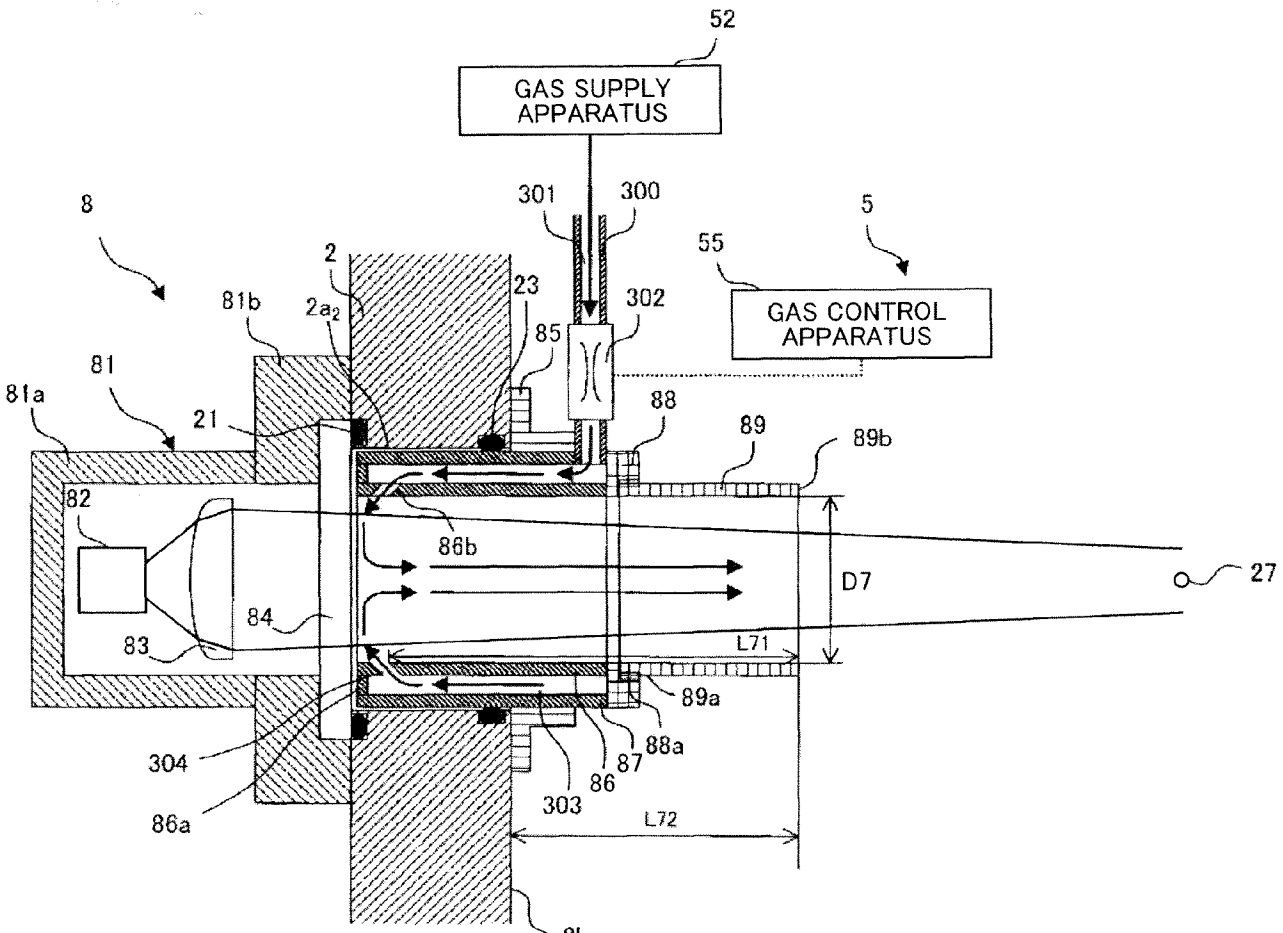
FIG. 13 is an enlarged view of the vicinity of a gas lock device according to a seventh embodiment.

FIG. 13 is an enlarged view of the vicinity of the gas lock device according to the seventh embodiment. The gas lock device according to the seventh embodiment changes the blowing portion 304 of the sixth embodiment, and thus the blowing portion 304 will be described hereinafter. The other constituent elements in the seventh embodiment may be the same as those in the sixth embodiment.

As shown in FIG. 13, as opposed to the sixth embodiment, the blowing portion 304 according to the seventh embodiment may be defined by forming the hole 86*b* that serves as an opening in the first cylinder member 86 so as to have a predetermined angle toward the window 84. The blowing portion 304 may be a plurality of holes or a ring-shaped slit serving as the opening.

5.7.2 Operation

The gas containing hydrogen gas that has been blown from the blowing portion 304 may collide with the window 84 and flow along the surface of the window 84 from the periphery of the window 84 toward the center thereof. The gas containing hydrogen gas that has reached the vicinity of the center of the window 84 may flow in a direction away from the window 84 and toward the third cylinder member 89. The gas containing hydrogen gas may flow along the first cylinder member 86 as a laminar flow. The other operations may be the same as those described in the sixth embodiment.

5.7.3 Effect

According to the seventh embodiment, the gas containing hydrogen gas collides with the window 84 that serves as an optical element and flows along the window 84, and as a result, even if debris has reached the window 84, the debris that has reached the window 84 may be blown off by the gas containing hydrogen gas. The other effects may be the same as those described in the sixth embodiment.

5.8 Eighth Embodiment

Next, an eighth embodiment of the gas lock device will be described.

5.8.1 Configuration

Figure 14:
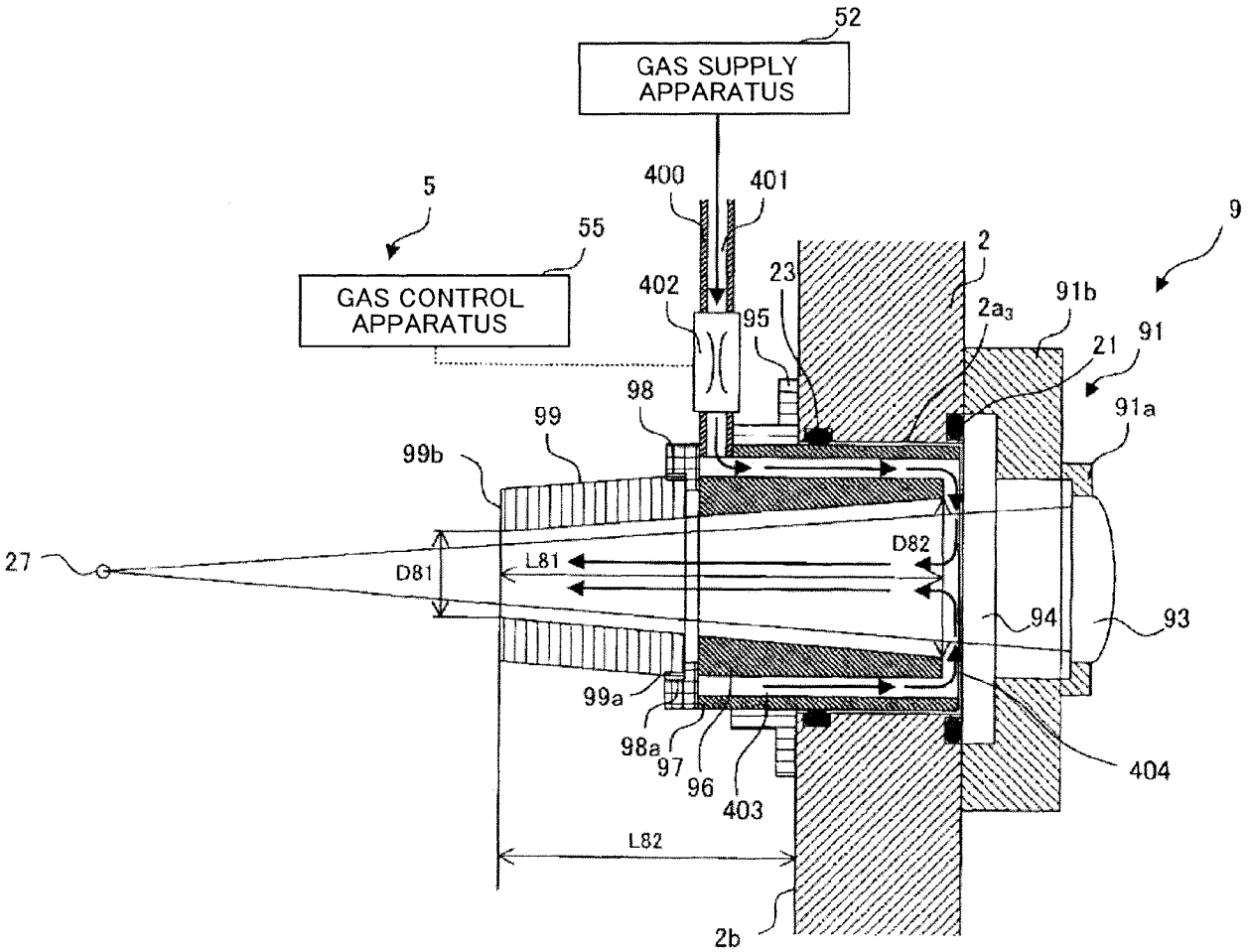
FIG. 14 is an enlarged view of the vicinity of a gas lock device according to an eighth embodiment.

FIG. 14 is an enlarged view of the vicinity of the gas lock device according to the eighth embodiment. The gas lock device according to the eighth embodiment may be used in the vicinity of the laser focusing section 9, for example.

As shown in FIG. 14, the laser focusing section 9 according to the eighth embodiment may include a holder 91, a focusing optical system 93, the window 94 serving as an optical element, a flange 95, a first cylinder member 96, a second cylinder member 97, a connecting member 98, a third cylinder member 99, a pipe 400, and an orifice portion 402.

An outer diameter of the first cylinder member 96 may be smaller than an inner diameter of the second cylinder member 97. The first cylinder member 96 may be inserted into the second cylinder member 97 so that a center axis of the first cylinder member 96 and a center axis of the second cylinder member 97 substantially match.

The holder 91 may include a focusing portion holder 91*a* and a window holder 91*b*. The focusing portion holder 91*a* may support the focusing optical system 93. The window holder 91*b* may be for attaching the window 94 to the chamber 2. The first O-ring 21 may be disposed between the window 94 and the chamber 2.

At least part of the first cylinder member 96 may be provided within a passage section $2a_3$ of the chamber 2, adjacent to the window 94. The first cylinder member 96 may be configured so that the inner diameter thereof decreases with distance from the window 94.

At least part of the second cylinder member 97 may be provided within the passage section $2a_3$ of the chamber 2, adjacent to the window 94. A second O-ring 23 may be disposed between the second cylinder member 97 and the chamber 2. The second cylinder member 97 may be attached to the chamber 2 via the flange 95.

The connecting member 98 may be attached to the first cylinder member 96 and the second cylinder member 97 at end portions thereof located on the opposite side to the side on which the window 94 is located, so as to seal a gap therebetween. The connecting member 98 may include a screw portion 98*a*. The third cylinder member 99 may include a screw portion 99*a* with which the screw portion 98*a* of the connecting member 98 is threaded. The third cylinder member 99 may be configured so that the inner diameter thereof decreases with distance from the window 94. In the eighth embodiment, a circular cone-shaped surface formed by inner surfaces of the first cylinder member 96 and the third cylinder member 99 may be formed along an optical path.

The connecting member 98 and the third cylinder member 99 need not be attached. In this case, a member that seals the gap between the first cylinder member 96 and the second cylinder member 97 may be attached instead of the connecting member 98.

A plurality of types of the connecting member 98 and the third cylinder member 99 may be prepared, each having different lengths and diameters. The connecting member 98 and the third cylinder member 99 may then be selected from among the plurality of types and used in accordance with the circumstances.

The pipe 400 may include the orifice portion 402. The pipe 400 may be connected at one end to at least one gas supply apparatus 52, and may be attached at another end to the second cylinder member 97. The interior of the pipe 400 may serve as a first flow channel 401, and a space defined by the first cylinder member 96 and the second cylinder member 97 may serve as a second flow channel 403. A blowing portion 404 may be defined by a gap between the one end portion of the first cylinder member 96 and the window 94. The blowing portion 404 may be a ring-shaped slit or a plurality of holes serving as an opening. Alternatively, the end portion may have the same configuration as the end portion of the cylinder member 76 according to the second embodiment. A flow channel may be formed by the first flow channel 401, the orifice portion 402, the second flow channel 403, and the blowing portion 404. The gap between the first cylinder member 96 and the window 94 may be 0.2 mm to 0.5 mm.

5.8.2 Operation

A laser beam generated by a laser apparatus (not shown) may be focused by the focusing optical system 93, traverse the window 94, and proceed toward the target 27.

The diameter of the orifice portion 402 may be controlled by the gas control apparatus 55 of the gas supply system 5. A flow rate of the gas containing hydrogen gas that flows through the first flow channel 401 may be adjusted by controlling the diameter of the orifice portion 402. The gas containing hydrogen gas whose flow rate has been adjusted by the orifice portion 402 may flow through the second flow channel 403. The gas containing hydrogen gas flowing through the second flow channel 403 may collide with the window 94 and be blown from the blowing portion 404 toward the inside of the first cylinder member 96 that is partially disposed within the passage section $2a_3$ of the chamber 2.

The gas containing hydrogen gas that has been blown from the blowing portion 404 may flow along the surface of the window 94 from the periphery of the window 94 toward the center thereof, as indicated by the arrows. The gas containing hydrogen gas that has reached the vicinity of the center of the window 94 may flow in a direction away from the window 94 and toward the third cylinder member 99. The gas containing hydrogen gas may flow along the first cylinder member 96 as a laminar flow.

5.8.3 Effect

According to the eighth embodiment, the Peclet number may be expressed as indicated in the following Formula (4).

$$Pe=\{(Q/P)(4/\pi\times D81\times D82)L1\}/Df \quad (4)$$

Here, D81 represents an inner diameter of a leading end 99*b* of the third cylinder member 99 (*m*), and D82 represents an inner diameter of the blowing portion 404 in the first cylinder member 96 (*m*).

According to the eighth embodiment, the blowing portion 404 may be disposed near the window 94, and it may therefore be possible to cause debris to flow in a direction away from the window 94 with certainty.

Furthermore, according to the eighth embodiment, the gas containing hydrogen gas may collide with the window 94 that serves as an optical element and flow along the window 94. As a result, even if the debris reaches the window 94, the debris that has reached the window 94 can be removed from the window 94 by the flow of the gas containing hydrogen gas.

Further still, according to the eighth embodiment, the flow rate of the gas containing hydrogen gas passing through the first flow channel 401 may be adjusted to an appropriate rate using the orifice portion 402 depending on circumstances, and the running costs may be reduced as a result.

In addition, according to the eighth embodiment, the gas containing hydrogen gas is blown from the blowing portion 404 into the passage section $2a_3$ of the chamber 2, and thus a relationship between a distance L82 from the inner-side surface 2*b* of the chamber 2 to the leading end 99*b* of the third cylinder member 99 and a distance L81 from the blowing portion 404 for the gas containing hydrogen gas to the leading end 99*b* of the third cylinder member 99 may be L82<L81. By increasing the distance L81 from the blowing portion 404 to the leading end 99*b* of the third cylinder member 99, the Peclet number indicated in Formula (4) can be increased, and debris may be suppressed from reaching the window 94 that serves as an optical element as a result.

In addition, according to the eighth embodiment, the connecting member 98 and the third cylinder member 99 may be selected from a plurality of types and used in accordance with circumstances such as a pressure, a temperature, or the like within the chamber 2, and as a result the distance L81 from the blowing portion 404 to the leading end 99*b* of the third cylinder member 99, the distance L82 from the inner-side surface 2*b* of the chamber 2 to the leading end 99*b* of the third cylinder member 99, and an inner diameter D81 of the third cylinder member 99 and an inner diameter D82 of the first cylinder member 96 may be changed. Accordingly, the Peclet number indicated in Formula (4) can be changed in accordance with the circumstances, and debris may be suppressed from reaching the window 94 that serves as an optical element as a result.

In addition, according to the eighth embodiment, the inner surfaces of the second cylinder member 97 and the third cylinder member 99 have a circular cone shape, and the flow velocity of the gas containing hydrogen gas can increase as the gas containing hydrogen gas approached the leading end 99*b* of the third cylinder member 99 as a result. Accordingly, as opposed to other embodiments, the Peclet number can be increased while keeping the same flow rate, and debris may be suppressed from reaching the window 94 that serves as an optical element as a result.

Finally, according to the eighth embodiment, the gas containing hydrogen gas can flow along the first cylinder member 96 as a laminar flow, and it may be possible to reduce the occurrence of situations in which a turbulent flow causes the debris to continue to remain.

5.9 Ninth Embodiment

Next, a ninth embodiment of the gas lock device will be described.

5.9.1 Configuration

Figure 15:
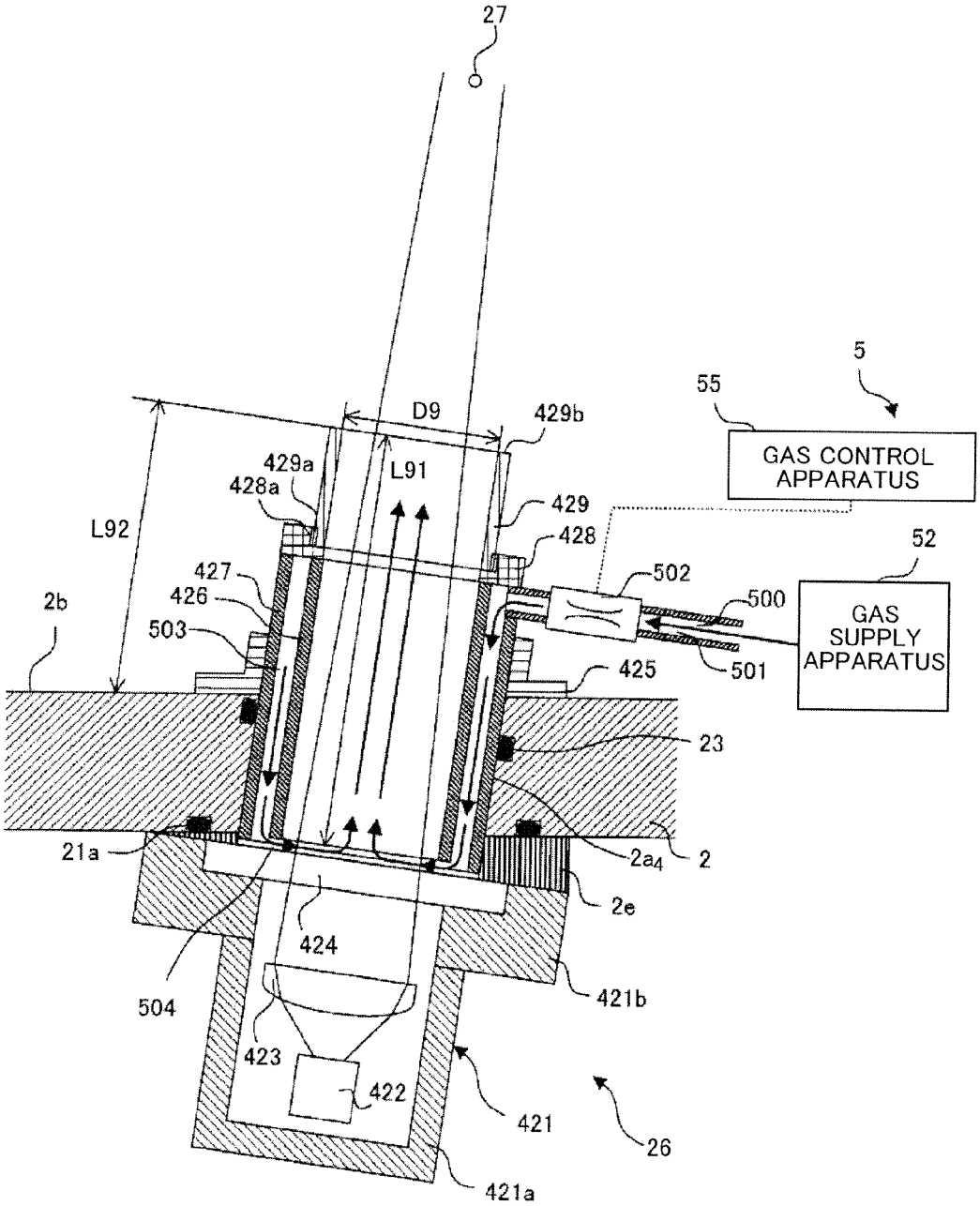
FIG. 15 is an enlarged view of the vicinity of a gas lock device according to a ninth embodiment.

FIG. 15 is an enlarged view of the vicinity of the gas lock device according to the ninth embodiment. The gas lock device according to the ninth embodiment may be used in the vicinity of the plasma sensor 26, for example.

As shown in FIG. 15, the plasma sensor 26 according to the ninth embodiment may include a holder 421, an image sensor 422, a transfer optical system 423, a window 424 that serves as an optical element, a flange 425, a first cylinder member 426, a second cylinder member 427, a connecting member 428, a third cylinder member 429, a pipe 500, and an orifice portion 502. Furthermore, a spacer 2*e* may be attached to the chamber 2 in order to attach the plasma sensor 26 at an angle.

An outer diameter of the first cylinder member 426 may be smaller than an inner diameter of the second cylinder member 427. The first cylinder member 426 may be inserted into the second cylinder member 427 so that a center axis of the first cylinder member 426 and a center axis of the second cylinder member 427 substantially match.

The holder 421 may include an image sensor holder 421*a* and a window holder 421*b*. The image sensor holder 421*a* may hold the image sensor 422 and the transfer optical system 423. The window holder 421*b* may be for attaching the window 424 to the chamber 2. A first O-ring 21*a* may be disposed between the spacer 2*e* and the chamber 2.

At least part of the first cylinder member 426 may be provided within a passage section $2a_4$.

At least part of the second cylinder member 427 may be provided within the passage section $2a_4$. The third O-ring 23 may be disposed between the second cylinder member 427 and the chamber 2. The second cylinder member 427 may be attached to the chamber 2 via the flange 425.

The connecting member 428 may be attached to the first cylinder member 426 and the second cylinder member 427 at end portions thereof located on the opposite side to the side on which the window 424 is located, so as to seal a gap therebetween. The connecting member 428 may include a screw portion 428*a*. The third cylinder member 429 may include a screw portion 429*a* with which the screw portion 428*a* of the connecting member 428 is threaded. The connecting member 428 and the third cylinder member 429 need not be attached. In this case, a member that seals the gap between the first cylinder member 426 and the second cylinder member 427 may be attached instead of the connecting member 428.

A plurality of types of the connecting member 428 and the third cylinder member 429 may be prepared, each having different lengths and diameters. The connecting member 428 and the third cylinder member 429 may then be selected from among the plurality of types and used in accordance with the circumstances.

The pipe 500 may include the orifice portion 502. The pipe 500 may be connected at one end to at least one gas supply apparatus 52, and may be attached at another end to the second cylinder member 427. The interior of the pipe 500 may serve as a first flow channel 501, and a space defined by the first cylinder member 426 and the second cylinder member 427 may serve as a second flow channel 503. A blowing portion 504 may be defined by a gap between the one end portion of the first cylinder member 426 and the window 424. The blowing portion 504 may be a ring-shaped slit or a plurality of holes. Alternatively, the end portion may have the same configuration as the end portion of the cylinder member 76 according to the second embodiment. A flow channel may be formed by the first flow channel 501, the orifice portion 502, the second flow channel 503, and the blowing portion 504. The gap between the first cylinder member 426 and the window 424 may be 0.2 mm to 0.5 mm.

5.9.2 Operation

Light radiated from the plasma may traverse the window 424, be focused by the transfer optical system 423, and proceed toward the image sensor 422.

The diameter of the orifice portion 502 may be controlled by the gas control apparatus 55 of the gas supply system 5. A flow rate of the gas containing hydrogen gas that flows through the first flow channel 501 may be adjusted by controlling the diameter of the orifice portion 502. The gas containing hydrogen gas whose flow rate has been adjusted by the orifice portion 502 may flow through the second flow channel 503. The gas containing hydrogen gas flowing through the second flow channel 503 may collide with the window 424 and be blown from the blowing portion 504 into the passage section $2a_4$ of the chamber 2.

The gas containing hydrogen gas that has been blown from the blowing portion 504 may flow along the surface of the window 424 from the periphery of the window 424 toward the center thereof, as indicated by the arrows. The gas containing hydrogen gas that has reached the vicinity of the center of the window 424 may flow in a direction away from the window 424 and toward the third cylinder member 429. The gas containing hydrogen gas may flow along the first cylinder member 426 as a laminar flow.

5.9.3 Effect

According to the ninth embodiment, the blowing portion 504 may be disposed near the window 424, and it may therefore be possible to cause debris 127*a* to flow in a direction away from the window 424 with certainty.

Furthermore, according to the ninth embodiment, the gas containing hydrogen gas may collide with the window 424 that serves as an optical element and flow along the window 424. As a result, even if the debris reaches the window 424, the debris that has reached the window 424 can be removed from the window 424 by the flow of the gas containing hydrogen gas.

Further still, according to the ninth embodiment, the flow rate of the gas containing hydrogen gas that is supplied from the first flow channel 501 can be adjusted to an appropriate rate using the orifice portion 502 according to the circumstances, and the running costs may be reduced as a result.

In addition, according to the ninth embodiment, a relationship between a distance L92 from the inner-side surface 2*b* of the chamber 2 to a leading end 429*b* of the third cylinder member 429 and a distance L91 from the blowing portion 504 for the gas containing hydrogen gas to the leading end 429*b* of the third cylinder member 429 may be $L92<L91$. By increasing the distance L91 from the blowing portion 504 to the leading end 429*b* of the third cylinder member 429, the Peclet number indicated in Formula (2) can be increased, and debris may be suppressed from reaching the window 424 that serves as an optical element as a result.

In addition, according to the ninth embodiment, the connecting member 428 and the third cylinder member 429 may be selected from a plurality of types and used in accordance with circumstances such as a pressure, a temperature, or the like within the chamber 2, and as a result the distance L91, the distance L92, and an inner diameter D9 of the third cylinder member 429 may be changed. Accordingly, the Peclet number indicated in Formula (4) can be changed in accordance with the circumstances, and debris may be suppressed from reaching the window 424 that serves as an optical element as a result.

Finally, according to the ninth embodiment, the gas containing hydrogen gas can flow along the first cylinder member 426 as a laminar flow. Accordingly, it may be possible to reduce the occurrence of situations in which a turbulent flow causes the debris to continue to remain.

6. Other

Next, another embodiment of the EUV light generation apparatus will be described.

6.1 Configuration

Figure 16:
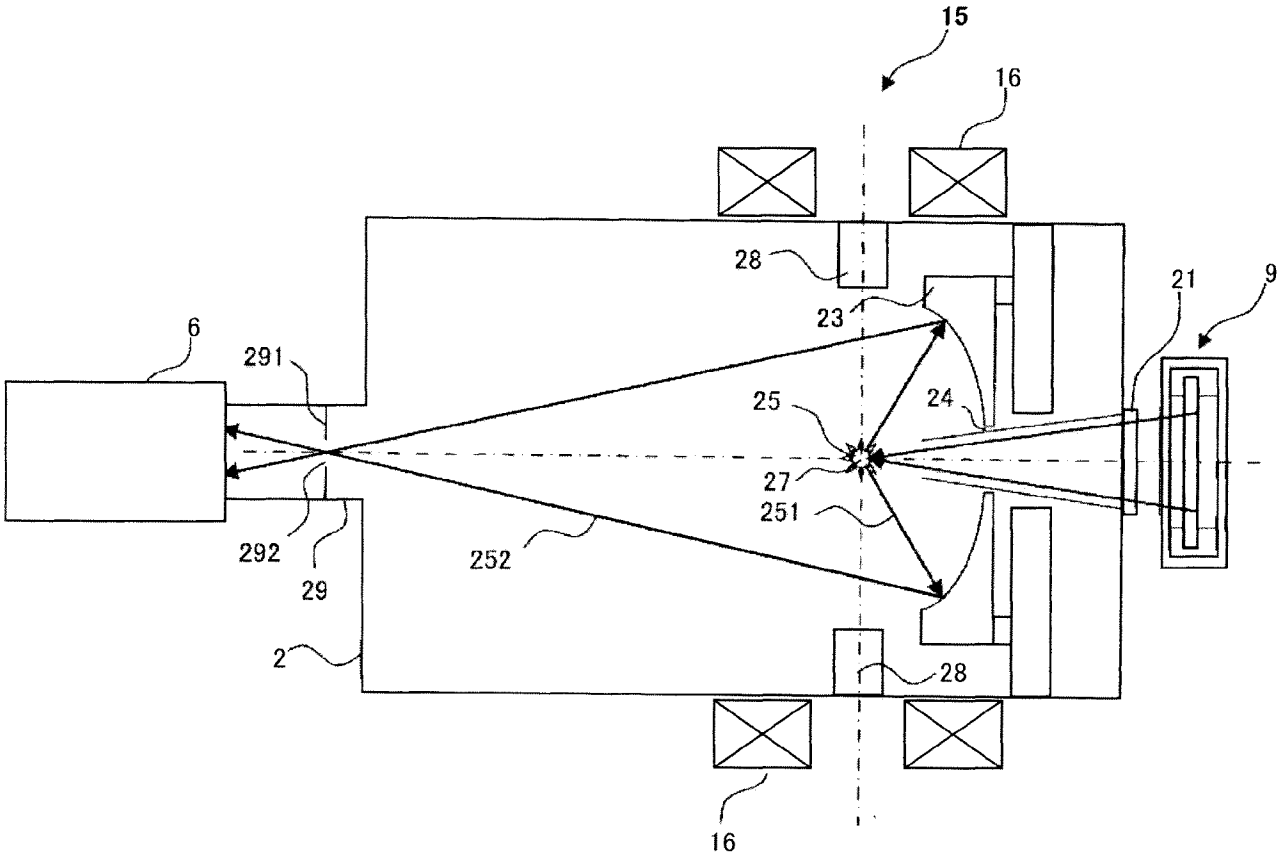
FIG. 16 is a plan view illustrating another embodiment of an EUV light generation apparatus.

FIG. 16 is a plan view illustrating another embodiment of the EUV light generation apparatus.

According to the embodiment illustrated in FIG. 16, the EUV light generation apparatus illustrated in FIG. 2 may be provided with a magnetic field generation device 15 that generates a magnetic field.

The magnetic field generation device 15 may include two coils 16. The two coils 16 may be toroidal coils. The two coils 16 may be disposed on outer sides of the chamber 2 so that the chamber 2 is located between the two coils 16. The toroidal center axis of the two coils 16 may pass through the plasma generation region 25. The target collector 28 may be disposed on an inner side of the chamber 2, upon the toroidal center axis of the two coils 16.

6.2 Operation

The two coils 16 may produce a magnetic field as a result of a current being supplied thereto from a power source (not shown). The magnetic field may be produced at the plasma generation region 25. When the target 27 reaches the plasma generation region 25 and is irradiated by the laser beam, plasma may be generated, and ions may also be generated. The generated ions may be trapped by the magnetic field and collected upon reaching the target collector 28.

At this time, the pressure of the gas containing hydrogen gas within the chamber 2 may be within a range from 0.1 to 20 Pa. As the pressure of the gas containing hydrogen gas increases, the generated ions can collide with the gas containing hydrogen gas and scatter, and the amount of ions collected in the target collector 28 may decrease as a result. As the amount of ions collected in the target collector 28 decreases, the remaining ions may adhere to the optical element or the like.

Accordingly, in the case of a device that traps ions by generating a magnetic field, the pressure of the gas containing hydrogen gas within the chamber 2 may be controlled to a predetermined value in the range from 0.1 to 20 Pa, and the flow rate of the gas containing hydrogen gas may be reduced. The gas lock devices according to the first to sixth embodiments may be useful in reducing the gas pressure within the chamber 2 and reducing the flow rate of the gas containing hydrogen gas.

Although the windows are given as examples of the optical elements used in the gas lock devices in all of the embodiments, the disclosure is not intended to be limited thereto, and optical elements such as lenses, mirrors, or the like may be used as well. Likewise, although the gas containing hydrogen gas is given as an example of the gas supplied to the chamber from the gas lock device, the gas may simply be hydrogen gas, or may be a gas produced by diluting hydrogen gas with another gas. Furthermore, although it is preferable for the gas supplied from the gas lock device to be a gas containing a component that is reactive with the target material, debris can be suppressed from reaching the optical element even in the case where an inert gas is used.

In addition, a pipe-shaped blowing portion, a slit-shaped blowing portion, or a hole-shaped blowing portion may be used as the blowing portion used in the gas lock device.

Further still, the first cylinder member and the second cylinder member used in the gas lock device are not limited to having cylindrical shapes, and may have elliptical, angled, or other cross-sections instead.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. A gas lock device for suppressing debris from reaching an optical element, the gas lock device comprising:

a chamber including a passage section and a connection hole that connects an interior surface of the chamber to a lateral face of the passage section, the optical element is attached to the chamber and seals the passage section, and the intersection of the connection hole to the lateral face is at an angle with respect to the lateral face;

a gas supply apparatus; and a pipe, attached at one end to the gas supply apparatus and attached at the other end to the chamber, that defines a flow channel communicating with the connection hole, such that a flow of gas is directed toward the optical element.

2. The gas lock device according to claim 1, further comprising a cylinder member that is at least partially disposed within the passage section, defines a flow channel that communicates with the connection hole by forming a gap between the cylinder member and the chamber, and in which a gap is formed with the optical element.

3. The gas lock device according to claim 1, further comprising a cylinder member that is at least partially disposed within the passage section, defines a flow channel that communicates with the connection hole by forming a gap between the cylinder member and the chamber, and in which an opening is formed in an area within the passage section.

4. The gas lock device according to claim 3, wherein the opening in the cylinder member is formed facing toward the optical element.

5. The gas lock device according to claim 2, further comprising another cylinder member attached to the cylinder member.

6. The gas lock device according to claim 2, wherein an inner diameter of the cylinder member decreases with distance from the optical element.

7. A gas lock device for suppressing debris from reaching an optical element, the gas lock device comprising:

a chamber including a passage section, and the optical element is attached to the chamber and seals the passage section;

a first cylinder member that is at least partially disposed within the passage section and in which a gap is formed with the optical element in a circumference of one end of the first cylinder member;

a second cylinder member, having an inner diameter that is greater than an outer diameter of the first cylinder member, that is at least partially disposed within the passage section and on an outer circumferential side of the first cylinder member;

a gas supply apparatus; and a pipe, attached at one end to the gas supply apparatus and attached at the other end to the second cylinder member, that defines a flow channel communicating with a gap between the first cylinder member and the second cylinder member.

8. A gas lock device for suppressing debris from reaching an optical element, the gas lock device comprising:

a chamber including a passage section, and the optical element is attached to the chamber and seals the passage section;

a first cylinder member that is at least partially disposed within the passage section and in which an opening is formed in an area within the passage section in a circumference of one end of the first cylinder member;

a second cylinder member, having an inner diameter that is greater than an outer diameter of the first cylinder member, that is at least partially disposed within the passage section and on an outer circumferential side of the first cylinder member;

a gas supply apparatus; and a pipe, attached at one end to the gas supply apparatus and attached at the other end to the second cylinder member, that defines a flow channel communicating with a gap between the first cylinder member and the second cylinder member.

9. The gas lock device according to claim 8, wherein the opening in the first cylinder member is formed facing toward the optical element.

10. The gas lock device according to claim 7, further comprising a third cylinder member attached to the first cylinder member and the second cylinder member.

11. The gas lock device according to claim 7, wherein an inner diameter of the first cylinder member decreases with distance from the optical element.

12. The gas lock device according to claim 7, further comprising a spacer that attaches the optical element to the chamber at an angle.

13. An extreme ultraviolet light generation apparatus comprising the gas lock device according to claim 7.

14. The gas lock device according to claim 3, further comprising another cylinder member attached to the cylinder member.

15. The gas lock device according to claim 3, wherein an inner diameter of the cylinder member decreases with distance from the optical element.

16. The gas lock device according to claim 7, wherein the gap is 0.2mm to 0.5 mm.

17. The gas lock device according to claim 8, wherein the opening is a hole or slit.

18. The gas lock device according to claim 1, further comprising a light source for emitting light toward the optical element, wherein the optical element is a window.

19. The gas lock device according to claim 7, further comprising a light source for emitting light toward the optical element, wherein the optical element is a window.

20. The gas lock device according to claim 8, further comprising an imaging sensor for detecting light traversing the optical element, wherein the optical element is a window.

* * * * *